US011318465B2

(12) United States Patent
Lin et al.

(10) Patent No.: US 11,318,465 B2
(45) Date of Patent: May 3, 2022

(54) ELECTROWETTING PANEL AND OPERATION METHOD THEREOF

(71) Applicant: Shanghai Tianma Micro-Electronics Co.,Ltd., Shanghai (CN)

(72) Inventors: Baiquan Lin, Shanghai (CN); Kerui Xi, Shanghai (CN); Junting Ouyang, Shanghai (CN); Jinyu Li, Shanghai (CN); Xiaohe Li, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 383 days.

(21) Appl. No.: 16/438,796

(22) Filed: Jun. 12, 2019

(65) Prior Publication Data

US 2020/0306750 A1 Oct. 1, 2020

(30) Foreign Application Priority Data

Mar. 26, 2019 (CN) ..... 201910233550.0

(51) Int. Cl.
*B01L 3/00* (2006.01)
*B01F 33/3031* (2022.01)

(52) U.S. Cl.
CPC ..... *B01L 3/50273* (2013.01); *B01F 33/3031* (2022.01); *B01L 3/502792* (2013.01); *B01L 2300/0819* (2013.01); *B01L 2400/0427* (2013.01)

(58) Field of Classification Search
None
See application file for complete search history.

(56) References Cited

U.S. PATENT DOCUMENTS

2013/0293246 A1* 11/2013 Pollack ..... B01L 3/502784 324/671

FOREIGN PATENT DOCUMENTS

| | | | |
|---|---|---|---|
| CN | 104035624 | A | 9/2014 |
| CN | 105916689 | A | 8/2016 |
| CN | 108693802 | A | 10/2018 |
| CN | 109078661 | A | 12/2018 |

* cited by examiner

*Primary Examiner* — J. Christopher Ball
(74) *Attorney, Agent, or Firm* — Anova Law Group, PLLC

(57) ABSTRACT

An electrowetting panel includes a base substrate; an electrode array layer, including a plurality of electrodes arranged into an array; an insulating hydrophobic layer; a microfluidic channel layer located on the base substrate. Each electrode of the plurality of electrodes is connected to a driving circuit, and a droplet can move along a first direction by applying an electric voltage on each electrode. The insulating hydrophobic layer is located on the electrode array layer, and the microfluidic channel layer is located on the insulating hydrophobic layer. The electrodes includes a plurality of driving electrodes and a plurality of detecting electrodes. Along the first direction, a number N of the driving electrodes is located between every two adjacent detecting electrodes, where N is a natural number. The electrowetting panel also includes a detecting chip electrically connected to the detecting electrodes.

20 Claims, 16 Drawing Sheets

ELECTROWETTING PANEL AND OPERATION METHOD THEREOF

CROSS-REFERENCES TO RELATED APPLICATIONS

This application claims the priority of Chinese patent application No. 201910233550.0, filed on Mar. 26, 2019, the entirety of which is incorporated herein by reference.

FIELD OF THE DISCLOSURE

The present disclosure generally relates to the field of electrowetting technology and, more particularly, relates to an electrowetting panel and an operation method thereof.

BACKGROUND

As a potential technology for realizing lab-on-a-chip, microfluidic chip research was started in the early 1990s. A microfluidic chip is able to integrate basic operating units such as units for sample preparation, reaction, separation, detection, etc. of biological, chemical, and medical analytical processes into a micrometer-scale chip, and form a network using micro-channels. Therefore, by passing controllable fluid through the whole system, various functions of conventional biological or chemical laboratories can be replaced, and the entire analysis process can be completed automatically. The technology of microfluidic chip has become one of the current research hotspots and one of the leading technologies in the world due to its great promising features, such as integration, automation, portability, high efficiency, etc., in various aspects. In the past two decades, digital microfluidic chips have shown an explosive trend in laboratory research and industrial applications. In particular, digital microfluidic chips based on micro-droplet manipulation have made great progress. The volume of the manipulated droplets may be able to reach micro-liter, or even nano-liter. Therefore, droplets with micro-liter sizes and nano-liter sizes can be more precisely mixed at the micro-scale, and the chemical reaction inside the droplets may also be more sufficient. In addition, different biochemical reaction processes inside the droplets can be monitored. Micro-droplets may contain cells and biomolecules, such as proteins and DNA, enabling high throughput monitoring. Among various methods for driving micro-droplets, a traditional method is to generate and control micro-droplets in micro-pipes. However, the manufacturing process of the micro-pipes is very complicated, and the micro-pipes are easily blocked. Therefore, the reuse rate of the micro-pipes is low, and complex peripheral apparatuses are also required for driving micro-droplets.

Dielectric wetting effect has been increasingly used to manipulate micro-droplets in digital microfluidic chips due to many advantages it demonstrates. Because a microfluidic chip based on dielectric wetting does not require any complex apparatus such as micro-pipes, micro-pumps, micro-valves, etc., it is featured with simple manufacturing process, low heat generation, fast response, low power consumption, simple package, etc. Therefore, the microfluidic chip based on dielectric wetting may be able to realize the dispensing, separation, transport, and merging operations of micro-droplets. A digital microfluidic chip based on electrowetting-on-dielectrics uses an electrode as a control unit to control the droplets, and thus a large number of electrode units are required. The electrode structure of a traditional digital microfluidic chip based on electrowetting-on-dielectric mainly has two types of configurations: one is a discrete electrode structure, and the other is a strip electrode structure. The discrete electrode structure uses discrete electrodes with a certain shape to individually control each droplet. In the discrete electrode structure, each discrete electrode is a control unit and requires a control signal.

On a digital two-dimensional microfluidic chip based on the electrowetting-on-dielectrics effect, continuous liquid is discretized by external driving force, and the formed tiny droplets are manipulated and analyzed. During the process, performing real-time and accurate detection of micro-scale droplets has important significance for subsequent programmatic experiments and reaction results. Different regions on the microfluidic chip may have different functions, such as mixing, splitting, heating, detecting, etc. Droplet is the smallest operating unit on the chip, and its motion path between different regions needs to be monitored in real-time. However, the existing technology may have the following problems. In an existing electrowetting panel (such as genetic testing panel, etc.), although the control circuit can be used to transmit droplets from a starting electrode to an end electrode, the position of the droplet cannot be monitored. Some of the droplets may have individual differences or environmental differences. For example, a droplet may have an overly large size or an excessively small size, may carry abnormal charges, may contain impurities or static charges introduced by the environment, may experience changes in temperature and/or humidity, etc. These individual differences or environmental variations likely cause the droplets to move abnormally. However, because of the absence of a position monitoring system, the driving circuit is unable to detect abnormal moves, and the control still follows a normal timing sequence. As such, not only the droplet may not be able to reach the end point, but also the afterwards normal movement of all the droplets is affected, which results in low reliability of the device.

Therefore, an urgent technical problem to be solved in the field is to provide an electrowetting panel and a corresponding operation method that are capable of realizing monitoring feedback on the position of the electrowetting droplets, avoiding abnormal function of the panel due to abnormal movement of the droplets, and improving the reliability of the operation of the panel. The disclosed electrowetting panel and operation method are directed to solve one or more problems set forth above and other problems in the art.

BRIEF SUMMARY OF THE DISCLOSURE

One aspect of the present disclosure provides an electrowetting panel. The electrowetting panel includes a base substrate; an electrode array layer; an insulating hydrophobic layer; and a microfluidic channel layer. A droplet is movable in the microfluidic channel layer, and the electrode array layer is located on a side of the base substrate. The electrode array layer includes a plurality of electrodes arranged into an array, each electrode of the plurality of electrodes is connected to a driving circuit, and a droplet can move in the microfluidic channel layer along a first direction by applying an electric voltage on each electrode of the plurality of electrodes through the driving circuit corresponding to each electrode. The insulating hydrophobic layer is located on a side of the electrode array layer away from the base substrate. The microfluidic channel layer is located on a side of the insulating hydrophobic layer away from the electrode array layer. The plurality of electrodes includes a plurality of driving electrodes and a plurality of detecting electrodes. Along the first direction, a number N of the plurality of driving electrodes is located between every two adjacent detecting electrodes of the plurality of detecting electrodes, where N is a natural number. The electrowetting panel also includes a detecting chip electrically connected to the plurality of detecting electrodes.

Another aspect of the present disclosure provides an operation method of an electrowetting panel. The method includes providing the electrowetting panel, including a base substrate; an electrode array layer; an insulating hydrophobic layer; and a microfluidic channel layer. A droplet is movable in the microfluidic channel layer, and the electrode array layer is located on a side of the base substrate. The electrode array layer includes a plurality of electrodes arranged into an array, each electrode of the plurality of electrodes is connected to a driving circuit, and a droplet can move in the microfluidic channel layer along a first direction by applying an electric voltage on each electrode of the plurality of electrodes through the driving circuit corresponding to each electrode. The insulating hydrophobic layer is located on a side of the electrode array layer away from the base substrate. The microfluidic channel layer is located on a side of the insulating hydrophobic layer away from the electrode array layer. The plurality of electrodes includes a plurality of driving electrodes and a plurality of detecting electrodes. Along the first direction, a number N of the plurality of driving electrodes is located between every two adjacent detecting electrodes of the plurality of detecting electrodes, where N is a natural number. The electrowetting panel also includes a detecting chip electrically connected to the plurality of detecting electrodes. The method further includes: in a first stage, using a detecting electrode and a driving electrode as transmission electrodes; and providing signals, by the driving circuit, with different electric potentials to the plurality of electrodes to generate an electric field between adjacent electrodes in the first direction to drive a droplet to move along the first direction in the microfluidic channel layer, and in a second stage, using the detecting electrode as an electrode for detecting the droplet; providing an electric potential of the detecting electrode higher than electric potentials of other electrodes adjacent to the detecting electrode by transmitting an electric-potential signal through the detecting chip; and determining whether the droplet is present on the detecting electrode according to a difference in a detection signal received by the detecting chip.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Various exemplary embodiments of the present disclosure will now be described in detail with reference to the accompanying drawings. It should be noted that the relative arrangement of the components and steps, numerical expressions and numerical values set forth in the embodiments are not intended to limit the scope of the present disclosure. The following description of the at least one exemplary embodiment is merely illustrative, and by no means can be considered as limitations for the application or use of the present disclosure.

It should be noted that techniques, methods, and apparatuses known to those of ordinary skill in the relevant art may not be discussed in detail, but where appropriate, the techniques, methods, and apparatuses should be considered as part of the specification.

In all of the examples shown and discussed herein, any specific value should be considered as illustrative only and not as a limitation. Therefore, other examples of exemplary embodiments may have different values.

It should be noted that similar reference numbers and letters indicate similar items in subsequent figures, and therefore, once an item is defined in a figure, it is not required to be further discussed or defined in the subsequent figures.

Figure 1:
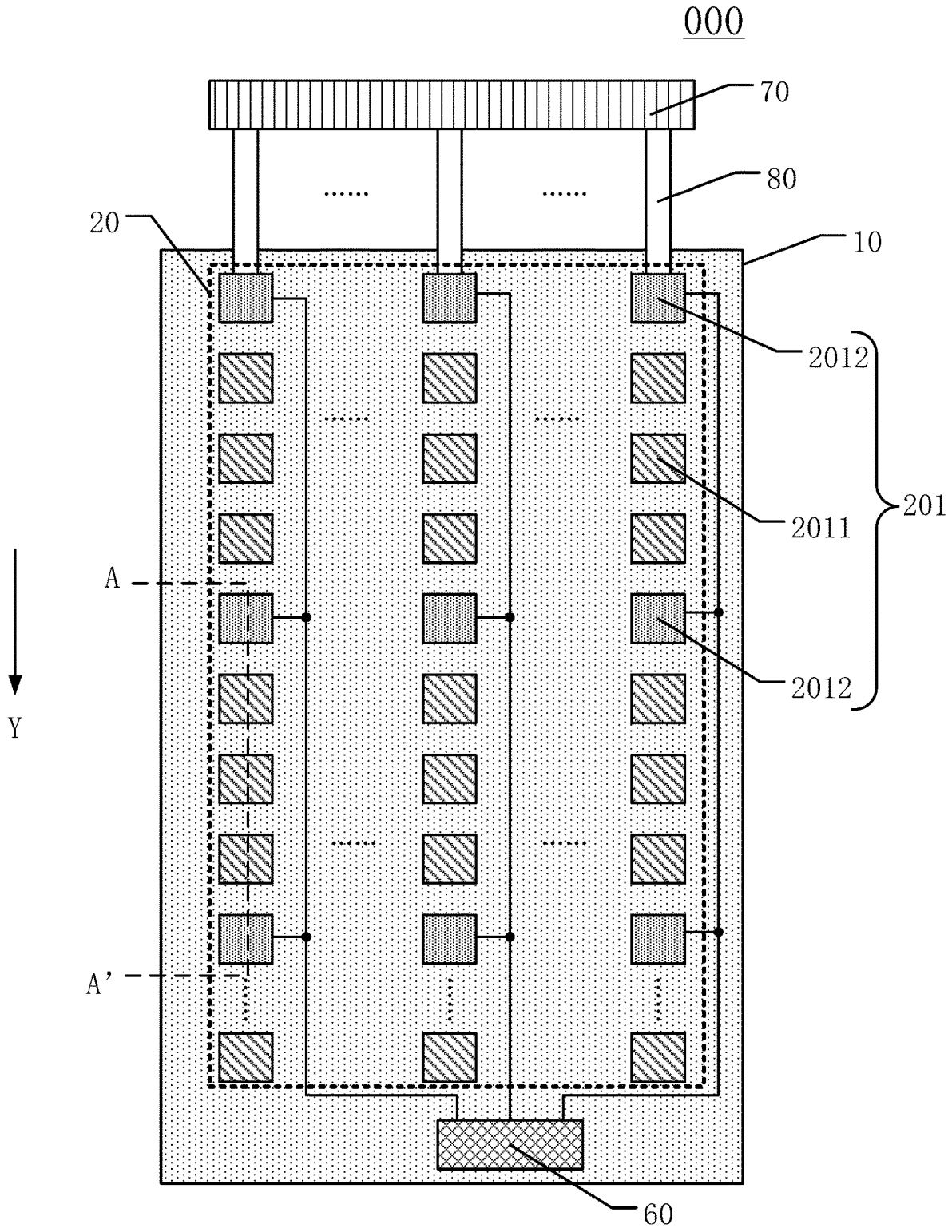
FIG. 1 illustrates a schematic plan view of an exemplary electrowetting panel according to various embodiments of the present disclosure.

The present disclosure provides an electrowetting panel. FIG. 1 illustrates a schematic plan view of an exemplary electrowetting panel according to various embodiments of the present disclosure, and FIG. 2 illustrates a schematic cross-sectional view of the electrowetting panel shown in FIG. 1 along an A-A' line.

Figure 2:
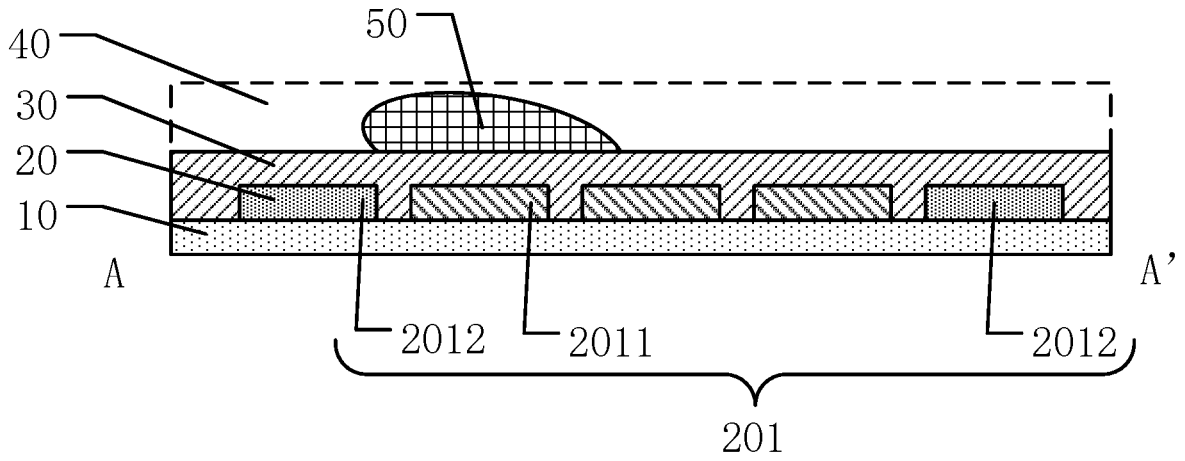
FIG. 2 illustrates a schematic cross-sectional view of the electrowetting panel shown in FIG. 1 along an A-A' line.

Referring to FIGS. 1-2, the electrowetting panel 000 may include a base substrate 10, an electrode array layer 20, an insulating hydrophobic layer 30, and a microfluidic channel layer 40. A plurality of droplets 50 may be present on the electrowetting panel 000. The plurality of droplets 50 may be movable in the microfluidic channel layer 40. The microfluidic channel layer 40 may be a physically-defined layer located above the insulating hydrophobic layer 30, e.g. the microfluidic channel layer 40 may have physically defined boundaries. Alternatively, the microfluidic channel layer 40 may be a virtual layer indicating the plane in which the movement trajectories of the plurality of droplets 50 are located. In one embodiment, the electrowetting panel 000 may further include a solution reservoir 70 and a plurality of liquid-inlet channels 80. The solution reservoir 70 may be used to store the plurality of droplets 50. The plurality of droplets 50 in the solution reservoir 70 may enter the microfluidic channel layer 40 through the plurality of liquid-inlet channels 80.

The electrode array layer 20 may be located on a side of the base substrate 10, and may include a plurality of electrodes 201 arranged into an array. Each electrode 201 may be connected to a driving circuit (not shown). By applying voltages on the plurality of electrodes 201 through the corresponding driving circuits, the plurality of droplets 50 may be movable in the microfluidic channel layer 40 along a first direction Y may be realized.

The insulating hydrophobic layer 30 may be located on the side of the electrode array layer 20 that is away from the base substrate 10.

The microfluidic channel layer 40 may be located on the side of the insulating hydrophobic layer 30 that is away from the electrode array layer 20.

The plurality of electrode 201 may include a plurality of driving electrodes 2011 and a plurality of detecting electrodes 2012. Along the first direction Y, the number N of the plurality of driving electrodes 2011 may be located between every two adjacent detecting electrodes 2012, where N is an integer larger than or equal to 0 (i.e., N is a natural number).

The electrowetting panel 000 may also include a detecting chip 60, and the detecting chip 60 may be electrically connected to the plurality of detecting electrodes 2012.

For example, in one embodiment, the electrowetting panel 000 may provide a voltage to each of the electrodes 201 through the driving circuit connected to the electrode 201, such that the voltages on adjacent electrodes 201 may be different, and an electric field may thus be formed between the adjacent electrodes 201. Therefore, a pressure difference and an asymmetric deformation may be generated inside the droplet 50, such that the droplet 50 may move along the first direction Y in the microfluidic channel layer 40 that is located above the insulating hydrophobic layer 30, and may eventually reach a desired position. It should be noted that FIG. 1 only schematically shows the first direction Y as the moving direction of the droplets 50, and in practical applications, the electric potentials of the electrodes 201 may be controlled to change the moving direction of the droplets 50.

The base substrate 10 may serve as a carrier for other film layers of the electrowetting panel, and the other film layers may be sequentially stacked on the base substrate 10. The insulating hydrophobic layer 30 may serve as an insulator and the microfluidic channel layer 40 may be used to guide the droplets 50 to move above the insulating hydrophobic layer 30.

In one embodiment, the electrode array layer 20 may include a plurality of electrodes 201 arranged into an array. The plurality of electrodes 201 may include a plurality of driving electrodes 2011 and a plurality of detecting electrodes 2012. Along the first direction Y, the number N of the plurality of driving electrodes 2011 may be located between every two adjacent detecting electrodes 2012. A detecting chip 60 may be electrically connected to the plurality of detecting electrodes 2012 for transmitting electrical signals with the plurality of detecting electrodes 2012. In one embodiment, similar to the driving electrode 2011, the detecting electrode 2012 may also be used for transmission.

In the course of a droplet 50 moving above a driving electrode 2011 under the control of a driving signal provided by the driving circuit, when the droplet 50 fails to reach the position of the detecting electrode 2012 due to unexpected reasons, the detecting electrode 2012 may send an abnormal signal to the detecting chip 60 to indicate that the droplet 50 does not reach the position of the detecting electrode 2012, and the detecting chip 60 may send an abnormal signal to the driving circuit to indicate that the droplet 50 does not reach the position of the detecting electrode 2012. The driving circuit may then drive the previous detecting electrode 2012 to resume operation such that the droplet 50 may continue to move in the microfluidic channel layer 40 along the first direction Y.

In one embodiment, detecting whether abnormality is taken place, e.g., the detecting chip 60 determining whether the droplet 50 is at the position of the detecting electrode 2012, may be performed according to the principle of capacitance change. For example, whether the droplet 50 reaches the position of a detecting electrode 2012, the capacitance formed between the detecting electrode 2012 at the position and other adjacent electrodes may have different values; therefore, whether the droplet 50 reaches the position of the detecting electrode 2012 may be determined by detecting the difference in the capacitance value of the signal received by the detecting chip 60. In one embodiment, monitoring and feeding back whether the droplet 50 reaches a designated position can be realized through the detecting electrode 2012 and the detecting chip 60. As such, abnormal function of the panel caused by abnormal movement of the droplet may be prevented. In addition, based on the feedback information of the detecting chip 60, the driving circuit may be able to re-provide a driving signal to the previous detecting electrode 2012, such that the droplet 50 may be able to continue normal movement in the microfluidic channel layer 40, thereby improving the reliability of the panel operation.

It should be noted that, in one embodiment, when the droplet 50 moves to the detecting electrode 2012, the detecting electrode 2012 may need to be kept at a high electric potential for a period of time such that the electric potentials of the adjacent electrodes 201 may not be higher than the electric potential of the detecting electrode 2012 (the droplet 50 is conducting liquid having a single component or multiple components and including biological samples or chemicals; as an example, in one embodiment, the droplet 50 is described to have negative charges, and thus the droplet 50 moves in a direction opposite to the electric filed line). As such, the droplet 50 can be kept at the position of the detecting electrode 2012 for a certain period of time, which is conducive to performing capacitance detection on the detecting electrode 2012 by the detecting chip 60. In one embodiment, the number N of the plurality of driving electrodes 2011 may be located between every two adjacent detecting electrodes 2012, where N is a natural number. When N is 0, each detecting electrode 2012 may be used for both detection and transmission. That is, each electrode 201 of the electrode array layer 20 may be multiplexed for detection and transmission, and the implementation of the different functions may only require the driving circuit to provide signals with different electric potentials, and thus may be conducive to saving the costs.

It should also be noted that, in one embodiment, the driving circuits that are electrically connected to the plurality of electrodes 201 may be integrated into the detecting chip 60 to save the space of the electrowetting panel, or may be integrated into another driving chip to prevent cross-interference of the signals. In practical applications, the arrangement of the driving circuits may be determined according to actual needs. Moreover, the shapes of the driving electrodes 2011 and the detecting electrodes 2012 shown in FIG. 1 are schematic, and in practical applications, the shapes of the electrodes may be determined according to actual needs.

In one embodiment, the electrode 201 can be driven through the electrical connection to the driving circuit, that is, each electrode 201 is electrically connected to a corresponding driving circuit, and the driving signal of an electrode 201 may be able to provide a corresponding electric-potential signal through the driving circuit that corresponds the electrode 201. The driving circuit may be a driving chip integrated with circuits that have driving functions, or a driving circuit formed by circuit elements disposed on the periphery of the plurality of electrodes.

Figure 3:
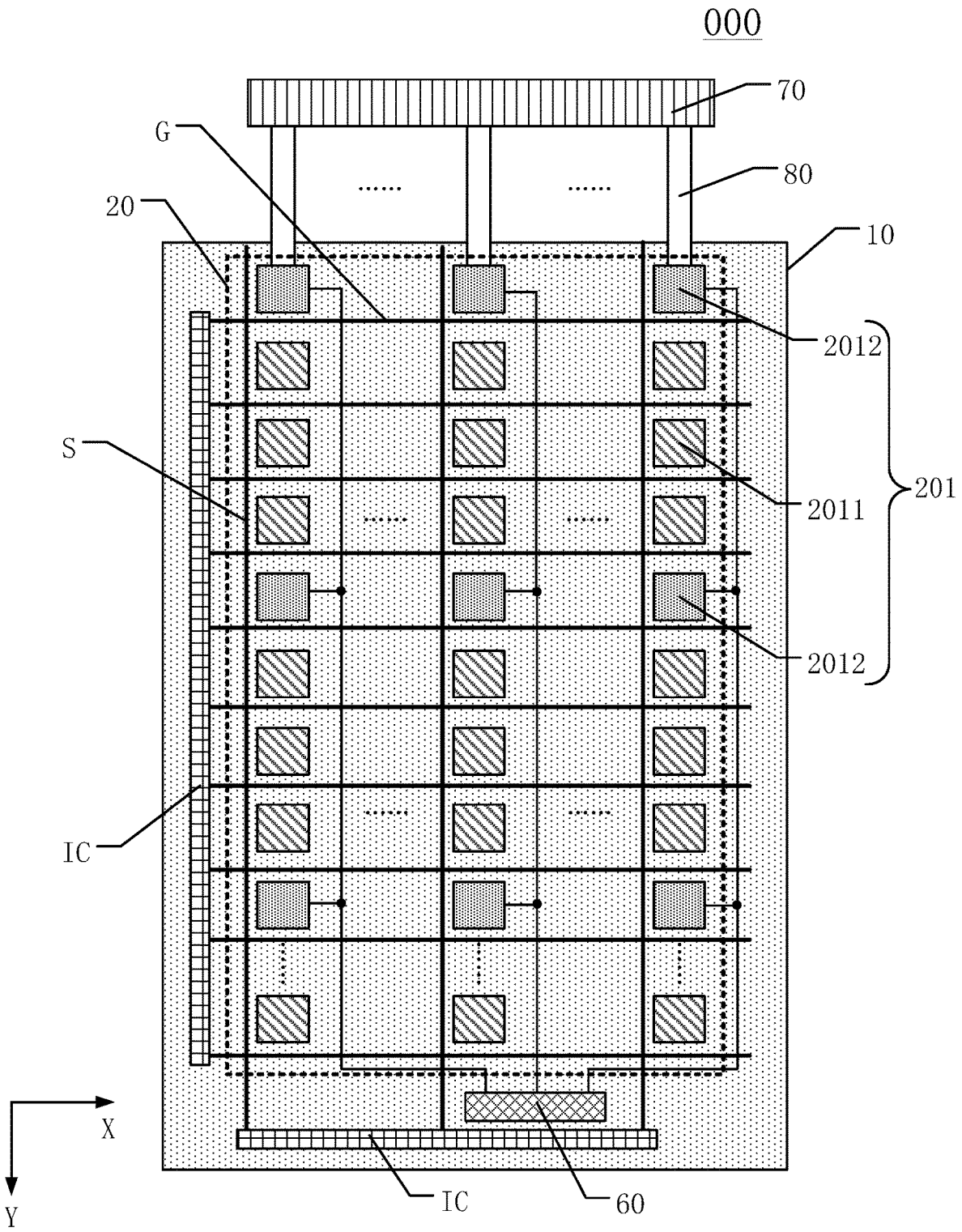
FIG. 3 illustrates a schematic plan view of another exemplary electrowetting panel according to various embodiments of the present disclosure.

In one embodiment, the plurality of electrodes 201 in the electrowetting panel 000 may provide driving signals through different signal lines that are disposed across but electrically isolated from each other. FIG. 3 illustrates a schematic plan view of another exemplary electrowetting panel according to various embodiments of the present disclosure.

Referring to FIG. 3, a plurality of first signal lines S extending along the first direction Y, a plurality of second signal lines G extending along a second direction X may be disposed on the base substrate 10 of the electrowetting panel 000. The plurality of first signal lines S and the plurality of second signal lines G may be disposed across but electrically isolated from each other to define a plurality of regions with each region corresponding to an electrode 201. Each electrode 201 in an electrode row along the second direction X may be electrically connected to a same second signal line G, and each electrode 201 in an electrode column along the first direction Y may be electrically connected to a same first signal line S. The plurality of first signal lines S and the plurality of second signal lines may be respectively connected to different driving chips IC to provide electrical signals. Each electrode 201 may be electrically connected to the first signal line S and the second signal line G through a switch transistor (not shown). In one embodiment, for each electrode 201, the second signal line G may be electrically connected to the gate electrode of the switch transistor that corresponds to the electrode 201, the first signal line may be electrically connected to the source electrode of the switch transistor that corresponds to the electrode 201, and the drain electrode of the switch transistor may be electrically connected to the electrode 201. Along the first direction Y, the driving chip IC that is electrically connected to the second signal line G may be used to provide driving signals such that the switch transistors of the plurality of electrodes 201 may be sequentially turned on. As such, the driving chip IC that is electrically connected to the first signal line S may sequentially write the electric-potential signals of the data to the source electrodes of the switch transistors corresponding to the plurality of electrodes 201 through the first signal line S. Therefore, the electrodes 201 electrically connected to the drain electrodes of the switch transistors may be able to obtain the corresponding electric-potential signals. By changing the electric-potential signals of the data of the first signal line S, electrical signals may be provided to different electrodes 201, and thus the signals received by the plurality of electrodes 201 may have different electric potentials.

The above embodiment is only for exemplifying the specific structure of the electrowetting panel 000. In practical applications, the structure can be designed according to actual needs, which is not described herein. FIG. 2 only illustrates a schematic structural diagram of the film layers of the electrowetting panel 000. However, the structure of the film layers is not limited to the embodiment, and in other applications, the electrowetting panel may have any other appropriate structure that is known to those skilled in the art.

In one embodiment, referring to FIG. 2, when droplets 50 are moving in the microfluidic channel layer 40 of the electrowetting panel 000, the orthogonal projection of each droplet 50 on the base substrate 10 may at least cover an electrode 201 and a portion of another electrode adjacent to the electrode 201.

For example, when a droplet 50 is moving in the microfluidic channel layer 40 of the electrowetting panel 000, the orthogonal projection of the droplet 50 on the base substrate 10 may need to at least cover an electrode 201 and a portion of another electrode adjacent to the electrode 201, such that when an electric field is formed between the electrode 201 and the electrode adjacent to the electrode 201, the pressure difference and the asymmetric deformation generated in the droplet 50 may be sufficient to drive the droplet 50 to move, preventing the formed electric field from being too small and thus causing undesirable move of the droplet 50. The droplet 50 may have a sufficiently large area overlapping with the electrodes adjacent to the electrode 201 where the droplet 50 is located, such that there is sufficient tensile force to overcome the resistance of the movement of the droplet 50, which may further enhance the driving force for the movement of the droplet 50.

Figure 4:
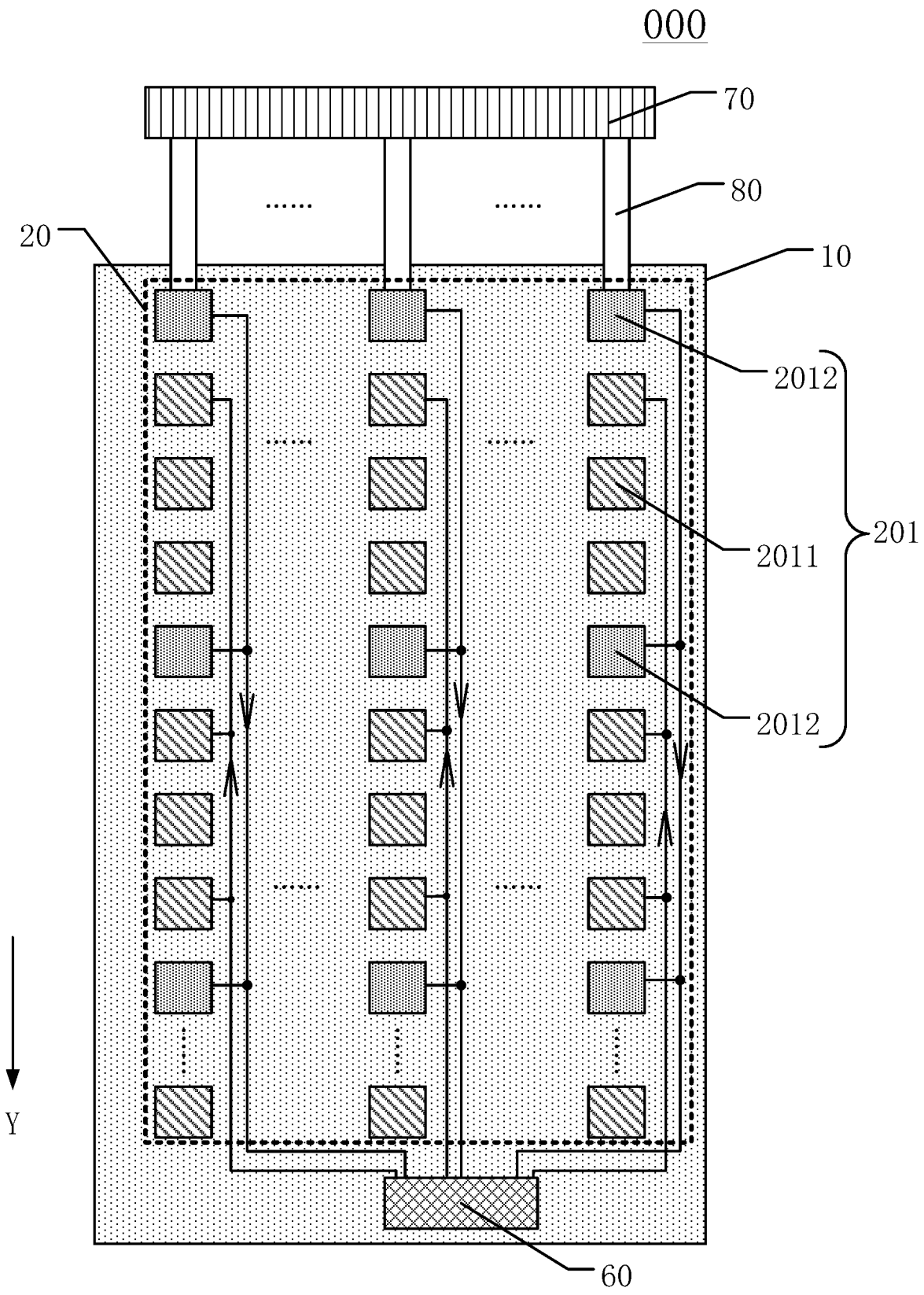
FIG. 4 illustrates a schematic plan view of another exemplary electrowetting panel according to various embodiments of the present disclosure.

FIG. 4 illustrates a schematic plan view of another exemplary electrowetting panel according to various embodiments of the present disclosure. Referring to FIG. 4, in one embodiment, the detecting chip 60 may receive the detection signals of the plurality of detecting electrodes 2012.

In one embodiment, when the detecting chip 60 and the detecting electrode 2012 are performing detecting operation, the detecting electrode 2012 may serve as an output terminal of the detection signal, and may be used to transmit the detected signal to the detecting chip 60. The detecting chip 60 may receive the detection signal of the detecting electrode 2012, and thus determine the position of the droplet 50 on the electrowetting panel 000. The electric-potential signal of the detecting electrode 2012 may be provided by the driving circuit. For example, when a detecting electrode 2012 is used as a detecting terminal, an electrode 201 around the detecting electrode 2012 or an auxiliary electrode may be used as the input terminal of the detection signal. The input terminal of the detection signal may be electrically connected to the detecting chip 60, and the electrical signal may be inputted through the detecting chip 60. As such, a capacitor may be formed between the detecting electrode 2012 and an electrode 201 around the detecting electrode 2012. Corresponding to different states where a droplet 50 is present at the position of the detecting electrode 2012 or not, the capacitance value of the formed capacitor may be different, and the detection signal received by the detecting chip 60 may also be different. By detecting the capacitance change, whether a droplet 50 is present at the position of the detecting electrode 2012 on the electrowetting panel may be determined, and thus monitoring and feeding back the position of an electrowetting droplet can be realized, preventing the panel function from becoming abnormal due to improper movement of the droplet 50. As such, the reliability of the panel operation may be improved.

Figure 5:
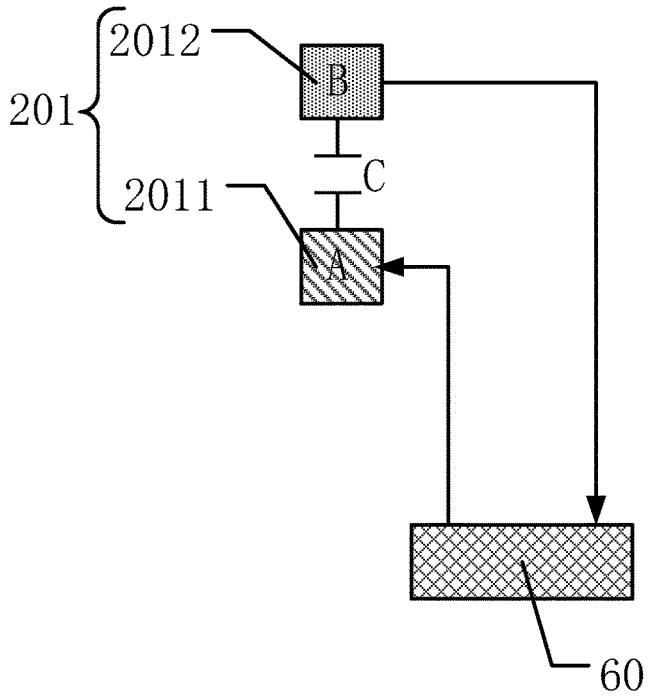
FIG. 5 illustrates a schematic diagram of the detection principle of the electrowetting panel shown in FIG. 4.

FIG. 5 illustrates a schematic diagram of the detection principle of the electrowetting panel shown in FIG. 4. Referring to FIGS. 4-5, in one embodiment, along the first direction Y, any one of the driving electrodes 2011 that are adjacent to the detecting electrode 2012 may be electrically connected to the detecting chip 60, and the detecting chip 60 may transmit a first electric-potential signal A to any one of the driving electrodes 2011 that are adjacent to the detecting electrode 2012.

In one embodiment, the plurality of driving electrodes 2011 adjacent to the detecting electrode 2012 may be electrically connected to the detecting chip 60, such that any one of the driving electrodes 2011 adjacent to the detecting electrode 2012 may serve as the input terminal of the detection signal. As such, the electrical signal of the detecting electrode 2012 may be inputted through a driving circuit. Moreover, the signal sent into any one of the driving electrodes 2011 adjacent to the detecting electrode 2012 through the detecting chip 60 may have an electric potential different from that of the detecting electrode 2012. Therefore, a capacitor C may be formed between the detecting electrode 2012 and any one of the driving electrode 2011 adjacent to the detecting electrode 2012. Further, according to the capacitance value detected by the detecting chip 60, whether a droplet 50 is present above the detecting electrode 2012 may be determined, and thus the reliability of the panel operation may be improved.

Figure 6:
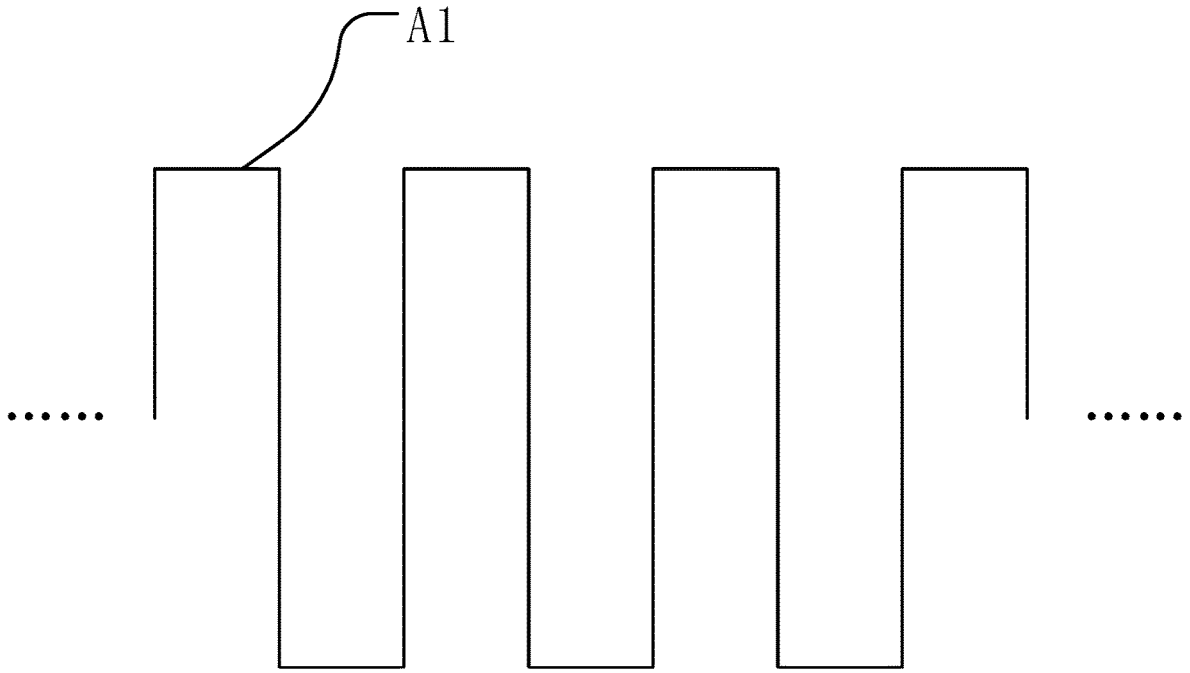
FIG. 6 illustrates a sequence diagram of a first electric-potential signal provided by the detecting chip shown in FIG. 4 to any one of the driving electrodes adjacent to the detecting electrode.

FIG. 6 illustrates a sequence diagram of a first electric-potential signal provided by the detecting chip shown in FIG. 4 to any one of the driving electrodes adjacent to the detecting electrode. Referring to FIGS. 4-6, in one embodiment, the first electric-potential signal A may be an AC signal, and when the detecting chip 60 receives the detection signal of the detecting electrode 2012, the electric potential of the detecting electrode 2012 may be a first detecting electric-potential signal B, and the peak electric potential A1 of the first electric-potential signal A may be lower than the electric potential of the first detecting electric-potential signal B.

In one embodiment, the first electric-potential signal A may be an AC signal. Because the capacitor formed between the detecting electrode 2012 and any one of the driving electrodes 2011 adjacent to the detecting electrode 2012 is able to block DC signal and transmit AC signal, the AC signal (i.e. AC component) of the first electric-potential signal A may be sent into any one of the driving electrodes 2011 adjacent to the detecting electrode 2012 through the detecting chip 60. At the same time, the detecting chip 60 may receive the signal of the detecting electrode 2012. The AC signal of any one of the driving electrodes 2011 adjacent to the detecting electrode 2012 may affect (however, with the influence taken into account, the lowest point of the electric potential of the detecting electrode 2012 is not lower than the electric potentials on the surrounding electrodes) the detecting electrode 2012 through the capacitor C between the two electrodes. Corresponding to whether a droplet is present on the detecting electrode 2012 or not, the capacitance value of the capacitor C may be different, and the signal detected by the detecting chip 60 may also be different. Therefore, by detecting the change in the capacitance value, whether a droplet is present at the position of the detecting electrode 2012 may be determined.

In this situation, in order to prevent the droplet 50 that is possibly located above the detecting electrode 2012 from moving under the electric field, the peak electric potential A1 of the first electric-potential signal A may need to be lower than the electric potential of the first detecting electric-potential signal B. The first detecting electric-potential signal B may be the electric potential of the detecting electrode 2012 when the detecting chip 60 receives the detection signal of the detecting electrode 2012. As such, the droplet 50 may be kept stationary at the position of the detecting electrode 2012, which is conducive to improving the detection accuracy.

It should be noted that, in one embodiment, the AC signal of the first electric-potential signal A may be a square wave signal as shown in FIG. 6, or may be a sine wave signal or any other form of AC signal where the peak electric potential A1 is lower than the electric potential of the first detecting electric-potential signal B.

Figure 7:
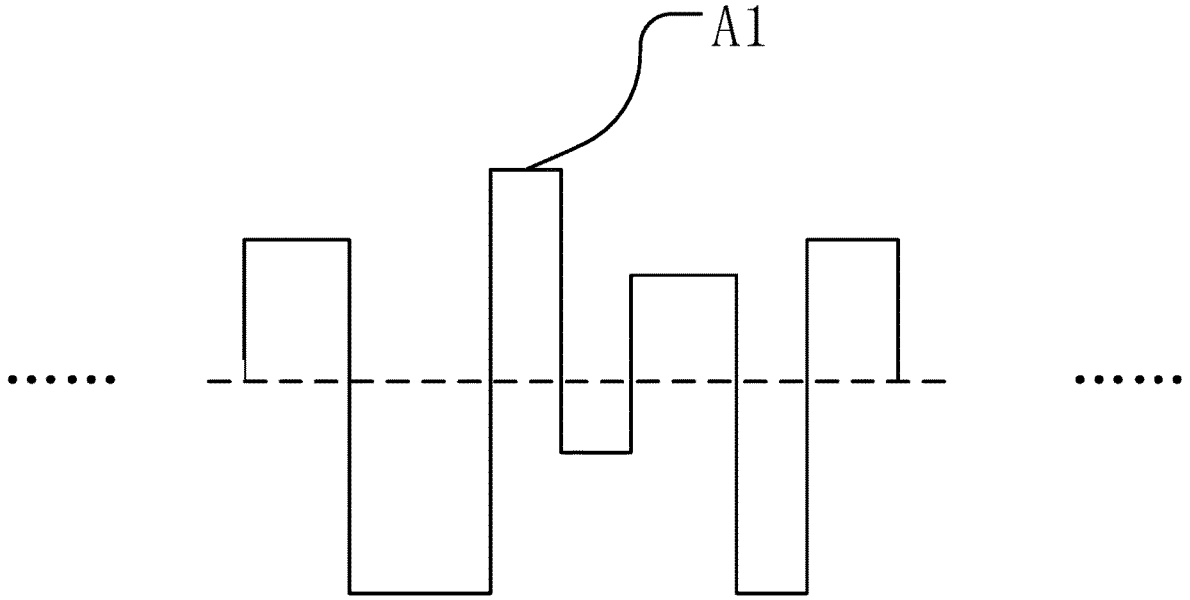
FIG. 7 illustrates another sequence diagram of a first electric-potential signal provided by the detecting chip shown in FIG. 4 to any one of the driving electrodes adjacent to the detecting electrode.

FIG. 7 illustrates another sequence diagram of a first electric-potential signal provided by the detecting chip shown in FIG. 4 to any one of the driving electrodes adjacent to the detecting electrode. In one embodiment, the AC signal of the first electric-potential signal A may be a regular symmetric AC signal as shown in FIG. 6. In other embodiments, the AC signal of the first electric-potential signal A may be an irregular (i.e., asymmetric) square wave signal as shown in FIG. 7, or other irregular (i.e., asymmetric) AC signal as long as the peak electric potential A1 is lower than the electric potential of the first detecting electric-potential signal B.

Figure 8:
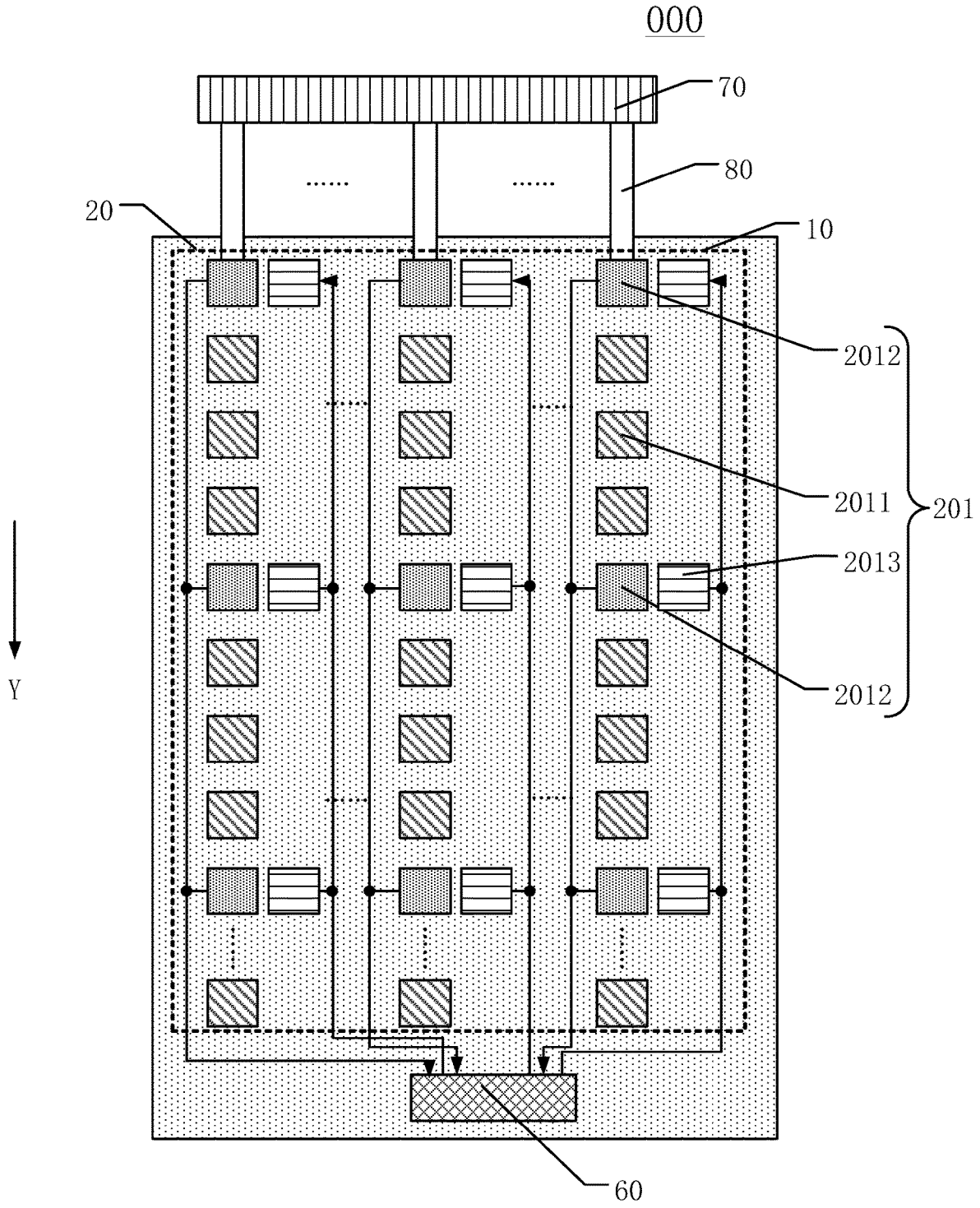
FIG. 8 illustrates a schematic plan view of another exemplary electrowetting panel according to various embodiments of the present disclosure.
Figure 9:
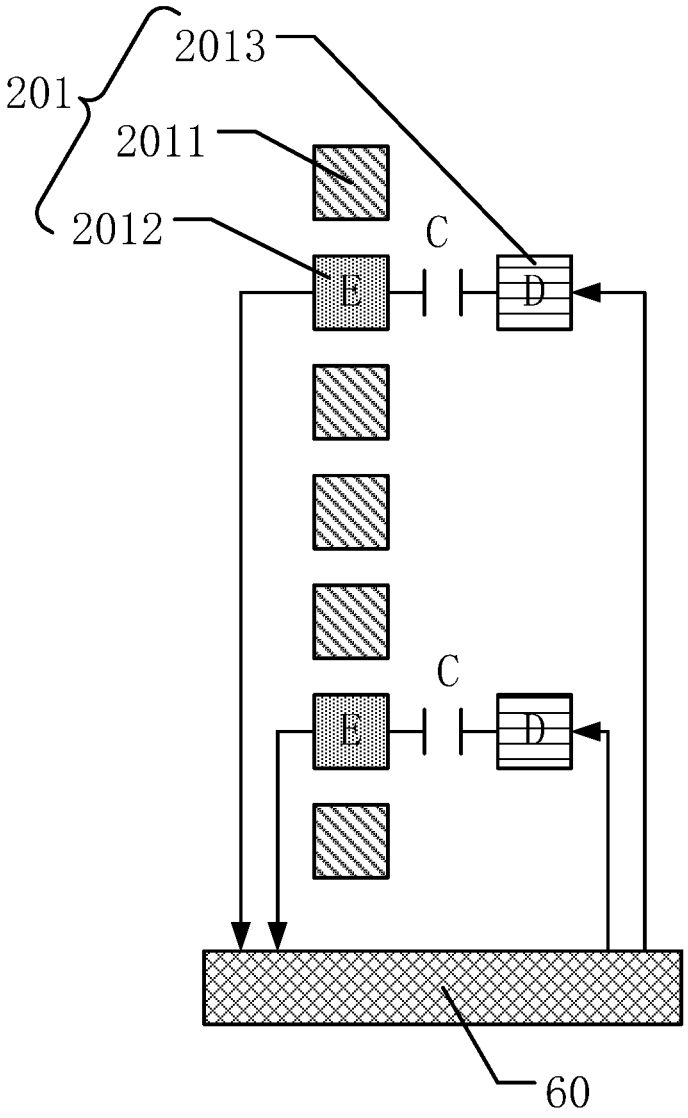
FIG. 9 illustrates a schematic diagram of the detection principle of the electrowetting panel shown in FIG. 8.

FIG. 8 illustrates a schematic plan view of another exemplary electrowetting panel according to various embodiments of the present disclosure, and FIG. 9 illustrates a schematic diagram of the detection principle of the electrowetting panel shown in FIG. 8. Referring to FIGS. 8-9, in one embodiment, the plurality of electrodes 201 may also include a plurality of auxiliary electrodes 2013. For example, along the second direction X, which is perpendicular to the first direction Y, each auxiliary electrode 2013 may be disposed on the side of a detecting electrode 2012. That is, the auxiliary electrode 2013 and the detecting electrode 2012 may be disposed laterally next to each other along the second direction X.

Each auxiliary electrode 2013 may be electrically connected to the detecting chip 60, and the detecting chip 60 may transmit a second electric-potential signal D to the auxiliary electrode 2013.

In one embodiment, by disposing an auxiliary electrode 2013 laterally on the side of each detecting electrode 2012 and electrically connecting the auxiliary electrode 2013 to the detecting chip 60, the auxiliary electrode 2013 may serve as the input terminal of the detection signal. As such, an electric potential signal may be sent into the detecting electrode 2012 through a corresponding driving circuit.

Moreover, the signal sent into the auxiliary electrode 2013 through the detecting chip 60 may have an electric potential different from that of the detecting electrode 2012. Therefore, a capacitor C may be formed between the detecting electrode 2012 and the auxiliary electrode 2013. Further, according to the capacitance value detected by the detecting chip 60, whether a droplet 50 is present above the detecting electrode 2012 may be determined, and thus the reliability of the panel operation may be improved. Therefore, by additionally providing an auxiliary electrode 2013 to assist the detection of the change in the capacitance value of the capacitor C formed between the detecting electrode 2012 and the auxiliary electrode 2013, the auxiliary electrode 2013 can be separately driven, such that other droplets 50 that are possibly present above other driving electrodes 2011 around the detecting electrode 2012 may not be disturbed during the detection period and thus the normal movement of these droplets may not be affected.

Figure 10:
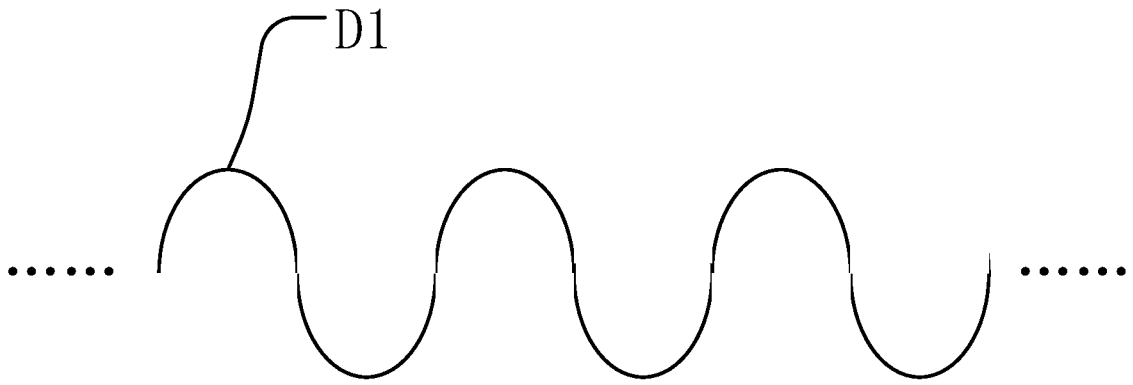
FIG. 10 illustrates a sequence diagram of a second electric-potential signal provided by the detecting chip shown in FIG. 4 to an auxiliary electrode.

FIG. 10 illustrates a sequence diagram of a second electric-potential signal provided by the detecting chip shown in FIG. 4 to an auxiliary electrode. Referring to FIGS. 8-10, in one embodiment, the second electric-potential signal D may be an AC signal, and when the detecting chip 60 receives the detection signal of a detecting electrode 2012, the electric potential of the detecting electrode 2012 may be a second detecting electric-potential signal E, and the peak electric potential D1 of the second electric-potential signal D may be lower than the electric potential of the second detecting electric-potential signal E.

In one embodiment, the second electric-potential signal D may be an AC signal. Because the capacitor formed between the detecting electrode 2012 and the auxiliary electrode 2013 is able to block DC signal and transmit AC signal, the AC signal (i.e. AC component) of the second electric-potential signal D may be sent into the auxiliary electrode 2013 through the detecting chip 60. At the same time, the detecting chip 60 may receive the signal of the detecting electrode 2012. The AC signal of the auxiliary electrode 2013 may affect (however, with the influence taken into account, the lowest point of the electric potential of the detecting electrode 2012 is not lower than the electric potentials on the surrounding electrodes) the detecting electrode 2012 through the capacitor C between the two electrodes. Corresponding to whether a droplet is present on the detecting electrode 2012 or not, the capacitance value of the capacitor C may be different, and the signal detected by the detecting chip 60 may also be different. Therefore, by detecting the change in the capacitance value, whether a droplet is present at the position of the detecting electrode 2012 may be determined.

In this situation, in order to prevent the droplet 50 that is possibly located above the detecting electrode 2012 from moving under the electric field, the peak electric potential D1 of the second electric-potential signal D may need to be lower than the electric potential of the second detecting electric-potential signal E. The second detecting electric-potential signal E may be the electric potential of the detecting electrode 2012 when the detecting chip 60 receives the detection signal of the detecting electrode 2012. As such, the droplet 50 may be kept stationary at the position of the detecting electrode 2012, which is conducive to improving the detection accuracy.

It should be noted that, in one embodiment, the AC signal of the second electric-potential signal D may be a sine wave signal as shown in FIG. 10, or may be a square wave signal or any other form of AC signal where the peak electric potential D1 is lower than the electric potential of the second detecting electric-potential signal E.

Figure 11:
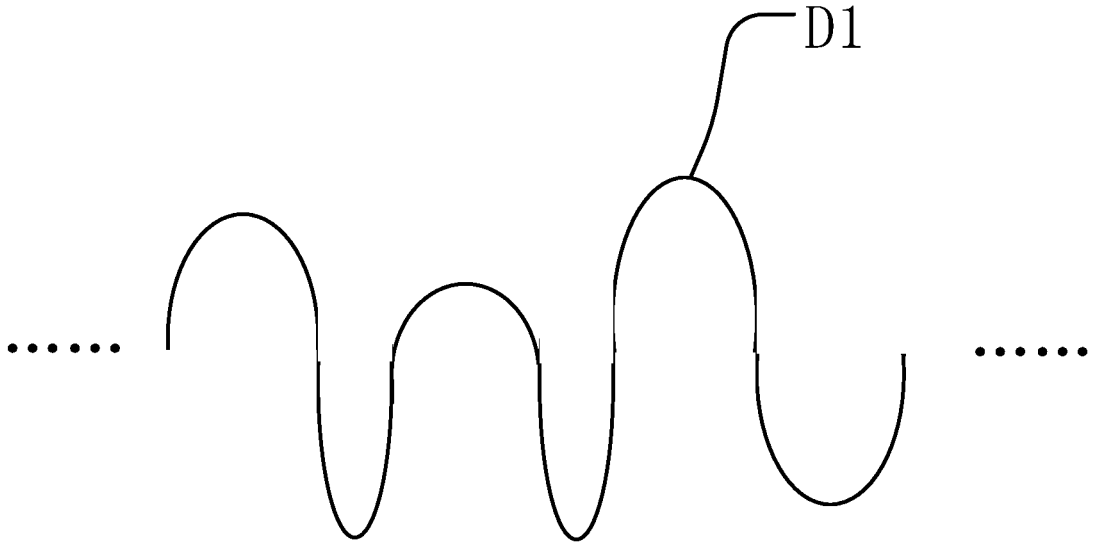
FIG. 11 illustrates another sequence diagram of a second electric-potential signal provided by the detecting chip shown in FIG. 4 to an auxiliary electrode.

FIG. 11 illustrates another sequence diagram of a second electric-potential signal provided by the detecting chip shown in FIG. 4 to an auxiliary electrode. In one embodiment, the AC signal of the second electric-potential signal D may be a regular symmetric AC signal as shown in FIG. 10. In other embodiments, the AC signal of the second electric-potential signal D may be an irregular (i.e., asymmetric) sine wave signal as shown in FIG. 11, or other irregular (i.e., asymmetric) AC signal where the peak electric potential D1 is lower than the electric potential of the second detecting electric-potential signal E.

Figure 12:
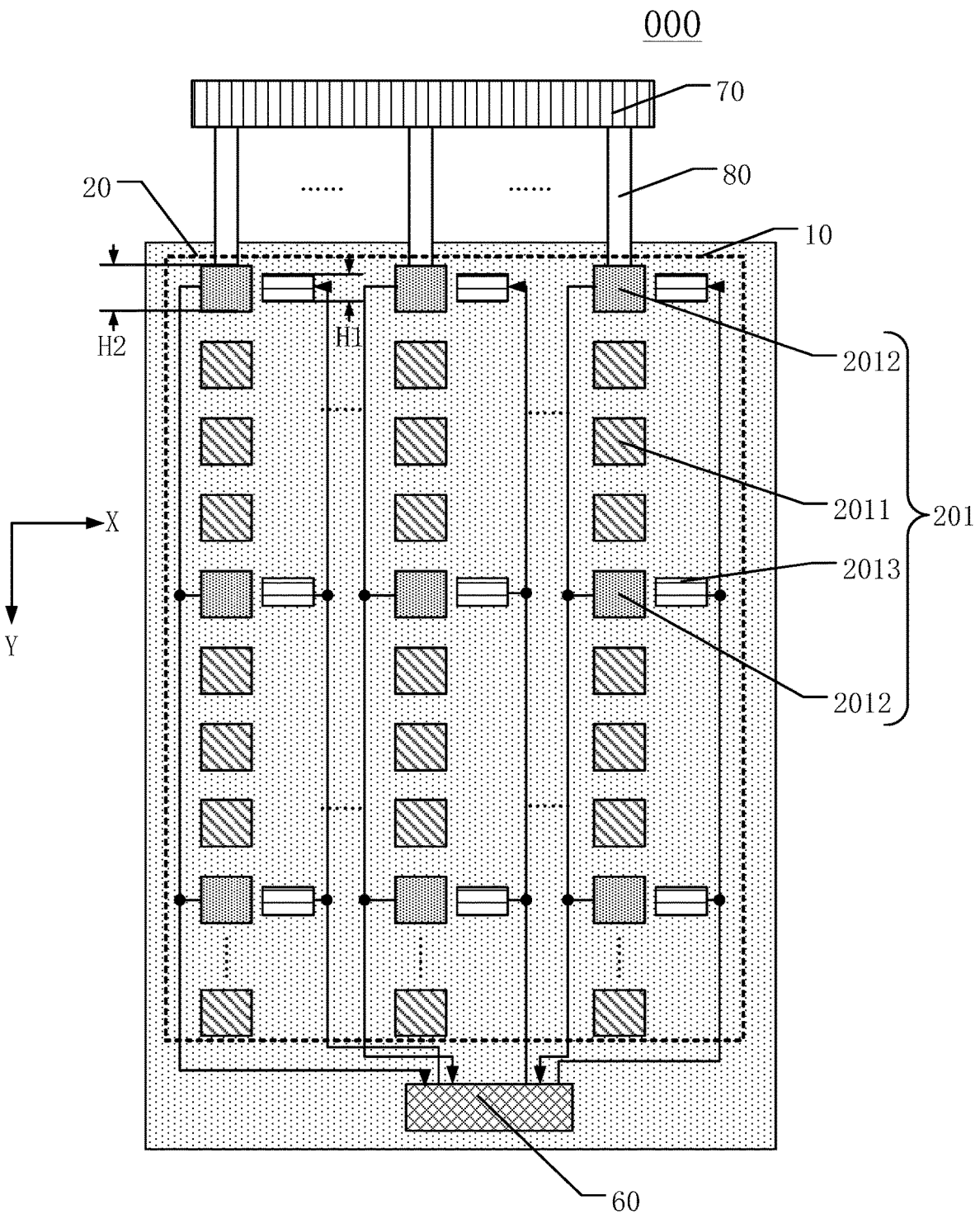
FIG. 12 illustrates a schematic plan view of another exemplary electrowetting panel according to various embodiments of the present disclosure.

FIG. 12 illustrates a schematic plan view of another exemplary electrowetting panel according to various embodiments of the present disclosure. Referring to FIG. 12, in one embodiment, a length H1 of the auxiliary electrode 2013 in the first direction Y may be smaller than or equal to a length H2 of the detecting electrode 2012 in the first direction Y.

In one embodiment, the auxiliary electrode 2013 may have a first length H1 in the first direction Y smaller than or equal to a first length H2 of the detecting electrode 2012 in the first direction Y. That is, when the auxiliary electrode 2013 is disposed laterally on the side of a detecting electrode 2012 in the second direction X, the length H1 of the auxiliary electrode 2013 in the first direction Y may not exceed the length H2 of the detecting electrode 2012 in the first direction Y. As such, when the detecting chip 60 provides an AC signal to the auxiliary electrode 2013, the AC signal may not affect the driving electrodes 2011 above and below the detecting electrode 2013, and thus the normal use of the panel may not be affected.

It should be noted that, the relationship between the width of the auxiliary electrode 2013 and the width of the detecting electrode 2012 along the second direction X is not specifically limited to the embodiments of the present disclosure, and when designing the panel, the width of the auxiliary electrode 2013 and the width of the detecting electrode 2012 may be designed flexibly according to actual needs.

Figure 13:
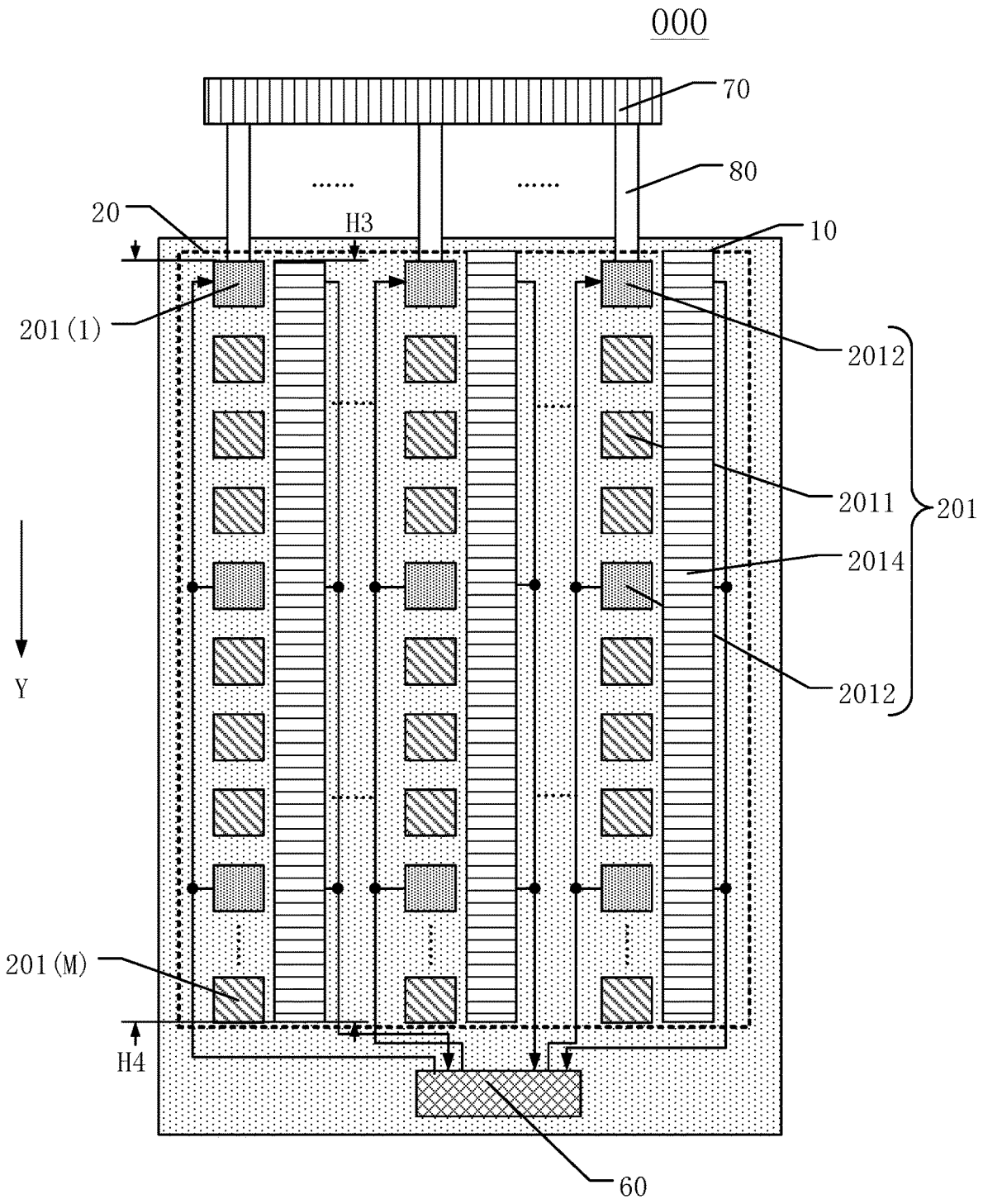
FIG. 13 illustrates a schematic plan view of another exemplary electrowetting panel according to various embodiments of the present disclosure.
Figure 14:
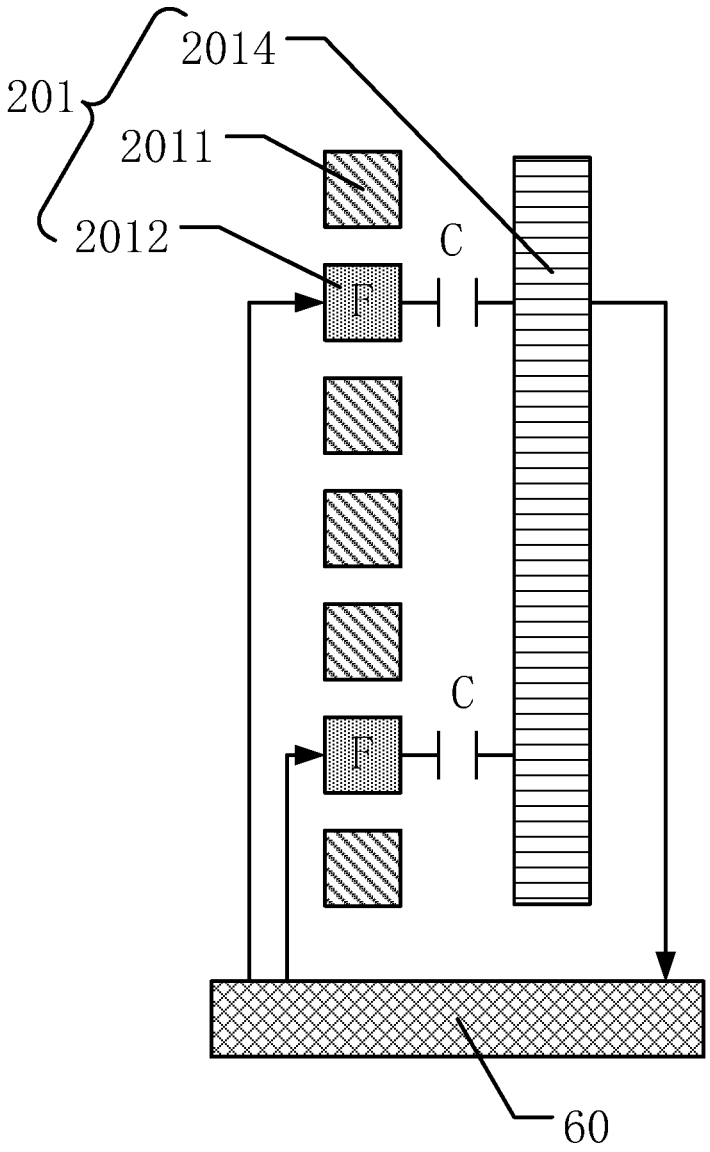
FIG. 14 illustrates a schematic diagram of the detection principle of the electrowetting panel shown in FIG. 13.

FIG. 13 illustrates a schematic plan view of another exemplary electrowetting panel according to various embodiments of the present disclosure, and FIG. 14 illustrates a schematic diagram of the detection principle of the electrowetting panel shown in FIG. 13. Referring to FIGS. 13-14, in one embodiment, the detecting chip 60 may transmit a third electric-potential signal F to a detecting electrode 2012. The third electric-potential signal F may be an AC signal, and the valley electric potential of the third electric-potential signal F may be higher than the electric potential of any one of the electrodes 201 adjacent to the detecting electrode 2012.

In one embodiment, the detecting electrode 2012 may serve as the input terminal of the detection signal, such that the third electric-potential signal F can be sent into the detecting electrode 2012 through the detecting chip 60. Moreover, the signal sent into any one of the electrodes 201 adjacent to the detecting electrode 2012 through a driving circuit may have an electric potential different from that of the detecting electrode 2012. Therefore, a capacitor C may be formed between the detecting electrode 2012 and any one of the electrodes 201 adjacent to the detecting electrode 2012. Further, according to the capacitance value detected by the detecting chip 60, whether a droplet 50 is present above the detecting electrode 2012 may be determined, and thus the reliability of the panel operation may be improved.

In one embodiment, the third electric-potential signal F may be an AC signal. Because the capacitor formed between the detecting electrode 2012 and any one of the electrodes 201 adjacent to the detecting electrode 2012 is able to block DC signal and transmit AC signal, the AC signal (i.e. AC component) of the third electric-potential signal F may be sent into the detecting electrode 2012 through the detecting chip 60. At the same time, the detecting chip 60 may receive the signal of any one of the electrodes 201 adjacent to the detecting electrode 2012. The AC signal of the detecting electrode 2012 may affect (however, with the influence taken into account, the lowest point of the electric potential of the detecting electrode 2012 is not lower than the electric potentials on the surrounding electrodes) any one of the electrodes 201 adjacent to the detecting electrode 2012 through the capacitor C between the two electrodes. Corresponding to whether a droplet is present on the detecting electrode 2012 or not, the capacitance value of the capacitor C may be different, and the signal detected by the detecting chip 60 may also be different. Therefore, by detecting the change in the capacitance value, whether a droplet is present at the position of the detecting electrode 2012 may be determined.

Moreover, in one embodiment, the third electric-potential signal F may be sent into the detecting electrode 2012 that needs to perform capacitance detection through the detecting chip 60. Therefore, when droplets are present not only on the detecting electrode 2012, but also on other electrodes 201, an AC signal sent into other electrodes 201 adjacent to the detecting electrode 2012 may not be able to affect other droplets during the detection period, and thus the normal operation of other droplets may not be affected.

In this situation, in order to prevent the droplet 50 that is possibly located above the detecting electrode 2012 from moving under the electric field, the valley electric potential of the third electric-potential signal F may need to be higher than the electric potential of the electric potential of any one of electrodes 201 adjacent to the detecting electrode 2012. As such, the droplet 50 may be kept stationary at the position of the detecting electrode 2012, which is conducive to improving the detection accuracy.

It should be noted that, in one embodiment, the AC signal of the third electric-potential signal F may be a square wave signal, a sine wave signal, or any other form of AC signal. In addition, the C signal of the third electric-potential signal F may be a regular symmetric AC signal, an irregular (i.e., asymmetric) square wave signal, or other irregular (i.e., asymmetric) AC signal where the valley electric potential is higher than the electric potential of the electric potential of any one of electrodes 201 adjacent to the detecting electrode 2012.

Further, referring to FIGS. 13-14, in one embodiment, the electrode array layer 20 may also include a plurality of auxiliary electrode strips 2014 extending along the first direction Y. Each auxiliary electrode strip 2014 may be electrically connected to the detecting chip 60, and the detecting chip 60 may receive the detection signal of the auxiliary electrode strip 2014.

In one embodiment, by disposing an auxiliary electrode strip 2014 laterally on the side of each detecting electrode 2012 and electrically connecting the auxiliary electrode strip 2014 to the detecting chip 60, the auxiliary electrode strip 2014 may serve as the output terminal of the detection signal. As such, an electric potential signal may be sent into the auxiliary electrode strip 2014 through a driving circuit. Moreover, an AC signal may be sent into the detecting electrode 2012 through the detecting chip 60. Therefore, a capacitor C may be formed between the detecting electrode 2012 and the auxiliary electrode strip 2014. Further, according to the capacitance value detected by the detecting chip 60, whether a droplet 50 is present above the detecting electrode 2012 may be determined, and thus the reliability of the panel operation may be improved. Therefore, by additionally providing an auxiliary electrode strip 2014 to assist the detection of the change in the capacitance value of the capacitor C formed between the detecting electrode 2012 and the auxiliary electrode strip 2014, the auxiliary electrode strip 2014 can be separately driven. Moreover, the AC signal may be sent to the detecting electrode 2012 which serves as the output terminal of the detection signal through the detecting chip 60, so that the AC signal may affect the electric potential signal of the auxiliary electrode strip 2014. Therefore, other droplets 50 that are possibly present on other electrodes 201 adjacent to the detecting electrode 2012 may not be disturbed during the detection period, and thus the normal movement of these droplets may not be affected.

Further, referring to FIGS. 13-14, in one embodiment, along the first direction Y, the number of the electrodes 201 included in the electrode array layer 20 may be M, and the length H3 of an auxiliary electrode strip 2014 in the first direction Y may be equal to the distance between the $1^{st}$ electrode 201 (1) and the $M^{th}$ electrode 201 (M) along the first direction Y, where M is a positive integer larger than or equal to 3.

In one embodiment, the auxiliary electrode strip 2014 may be arranged to have an elongated (strip) shape, and the length of the auxiliary electrode strip 2014 in the first direction Y may be equal to the distance H4 from the $1^{st}$ electrode 201 (1) to the $M^{th}$ electrode 201 (M), such that the number of signal lines of the plurality of auxiliary electrode strips 2014 and the detecting chip 60 may be reduced, thereby saving the manufacturing cost of the panel, improving the manufacturing efficiency, and reducing the process difficulty.

Figure 15:
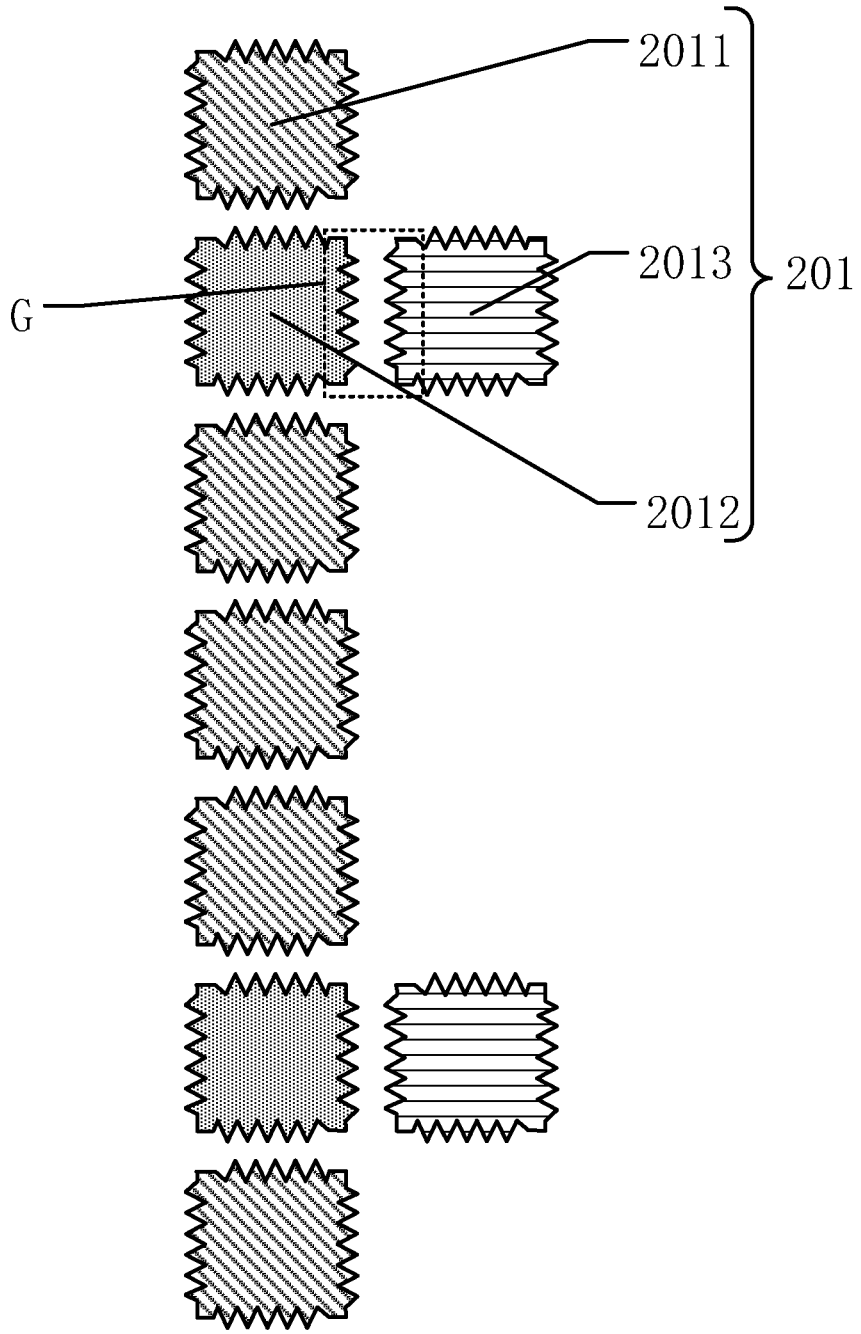
FIG. 15 illustrates a partial enlarged view of an exemplary electrode according to various embodiments of the present disclosure.

FIG. 15 illustrates a partial enlarged view of an exemplary electrode according to various embodiments of the present disclosure. Referring to FIG. 15, in one embodiment, the edges of the electrode 201 may have zigzag structures.

In one embodiment, each electrode 201 may be arranged to have zigzag edges. Because an electric field needs to be formed between adjacent electrodes 201 to drive droplets 50 to move, by arranging the edges of each electrode 201 into zigzag structures, the overlapped length between adjacent electrodes 201 may be increased, and the direct facing area between adjacent electrodes 201 may be effectively increased, such that the capacitance formed between the two electrodes may be improved, and thus may be easier for detection. In addition, the increase in the strength of the electric field formed between adjacent electrodes 201 may be more advantageous for driving the droplet to move.

Figure 16:
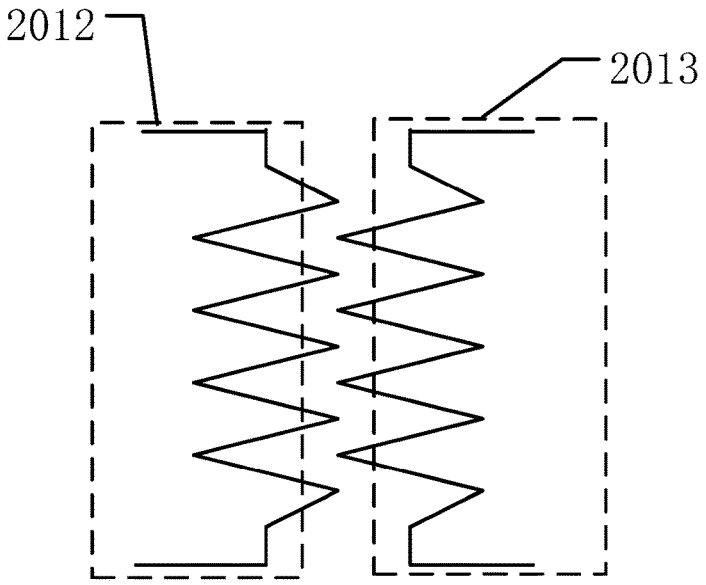
FIG. 16 illustrates a partial enlarged view of the electrode at the edge position of a region G shown in FIG. 15.

FIG. 16 illustrates a partial enlarged view of the electrode at the edge position of a region G shown in FIG. 15. Referring to FIG. 16, in one embodiment, the edges of adjacent electrodes 201 may mutually, conformally fit with each other. That is, the zigzag structures of the two edges that are respectively from two adjacent electrodes 201 may be identical in shape and arranged opposite to each other.

In one embodiment, not only the edges of the plurality of electrodes 201 have zigzag structures, but the zigzag structures of the two edges that are respectively from two adjacent electrodes 201 may be identical in shape and arranged opposite to each other, so that the overlapped length between adjacent electrodes 201 may be increased. As such, while the direct facing area between adjacent electrodes 201 is effectively increased, the area occupied by the electrode 201 in the electrowetting panel may not be increased, which is advantageous for reasonably arranging the panel structure, and saving the panel space.

Figure 17:
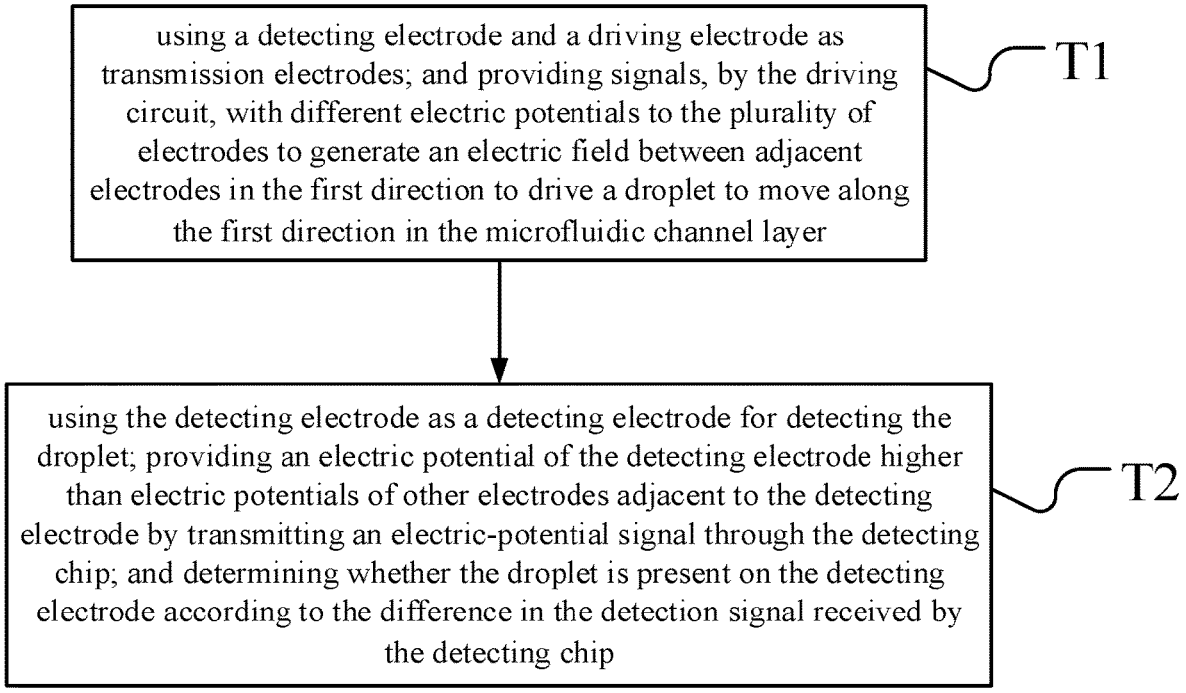
FIG. 17 illustrates a flow chart of an exemplary operation method of an electrowetting panel according to various embodiments of the present disclosure.

The present disclosure also provides an operation method of an electrowetting panel. FIG. 17 illustrates a flow chart of an exemplary operation method of an electrowetting panel according to various embodiments of the present disclosure. Referring to FIG. 17, in the operation method of the electrowetting panel, the electrowetting panel may be consistent with various embodiments of the present disclosure. The operation method of the electrowetting panel may include the following exemplary steps.

In a first stage T1, a detecting electrode 2012 and a driving electrode 2011 may be both used as transmission electrodes for droplets, and the driving circuit may provide signals with different electric potentials to the plurality of electrodes 201 to generate an electric field between adjacent electrodes 201 in the first direction Y, such that the electric field may drive droplets 50 to move along the first direction Y in the microfluidic channel layer 40.

In a second stage T2, the detecting electrode 2012 may be used for detecting the droplet 50. By transmitting an electric-potential signal through a detecting chip 60, the electric potential of the detecting electrode 2012 may be higher than the electric potentials of other electrodes 201 that are adjacent to the detecting electrode 2012. According to the difference in the detection signal received by the detecting chip 60, whether a droplet 50 is present on the detecting electrode 2012 may be determined.

According to the operation method of the disclosed electrowetting panel, an electrical voltage may be applied to each electrode 201 through a driving circuit that is connected to the electrode 201, such that the voltages on the adjacent electrodes 201 may be different, and thus an electric field may be formed between adjacent electrodes 201. A pressure difference and an asymmetric deformation may thus be generated inside the droplet 50, such that the droplet 50 may move along the first direction Y in the microfluidic channel layer 40 above the insulating hydrophobic layer 30, and may eventually reach a desired position. In one embodiment, the disclosed method may include determining whether a droplet 50 is present at the position of the detecting electrode 2012 through the detecting chip 60. For example, detecting abnormality may be performed based on the principle of capacitance change. Corresponding to whether the droplet 50 reaches the position of a detecting electrode 2012, the capacitance formed between the detecting electrode at the position and other surrounding electrodes may be different, and thus by detecting the difference in the magnitude of the capacitance signal received by the detecting chip 60, whether the droplet 50 is at the position of the detecting electrode 2012 may be determined.

The disclosed operation method of the electrowetting panel may include two stages. In the first stage T1, the detecting electrode 2012 and the driving electrode 2011 may be both used as transmission electrodes for droplets, and the driving circuit may provide signals with different electric potentials to the plurality of electrodes 201 to generate an electric field between adjacent electrodes 201 in the first direction Y, such that the electric field may drive droplets 50 to move along the first direction Y in the microfluidic channel layer 40. In the second stage T2, the detecting electrode 2012 may be used to detect the droplet 50. For example, through the detecting electrode 2012 and the detecting chip 60, monitoring and feeding back whether the droplet 50 reaches a designated position can be realized. As such, abnormal function of the panel caused by abnormal movement of the droplet may be prevented, and the reliability of the panel operation may be improved.

Further, referring to FIG. 17, in one embodiment, determining whether a droplet 50 is present on the detecting electrode 2012 according to the difference in the detection signal received by the detecting chip 60 may include the following exemplary steps.

When a droplet 50 is present on the detecting electrode 2012, a first capacitor may be formed between the detecting electrode 2012 and other electrodes 201 adjacent to the detecting electrode 2012.

When no droplet 50 is present on the detecting electrode 2012, a second capacitor may be formed between the detecting electrode 2012 and other electrodes 201 adjacent to the detecting electrode 2012. The capacitance value of the first capacitor may be different from the capacitance value of the second capacitor, and accordingly, the detection signals received by the detecting chip 60 may also be different. Therefore, according to the difference in the detection signal received by the detecting chip 60, whether a droplet 50 is present on the detecting electrode 2012 may be determined.

Further, referring to FIG. 17, in some embodiments, when a droplet 50 is present on the detecting electrode 2012, the driving circuit may continue to operate, and the droplet 50 may continue to move in the microfluidic channel layer 40 along the first direction Y.

When no droplet 50 is present on the detecting electrode 2012, the detecting chip 60 may send an abnormal signal to the driving circuit to indicate that no droplet 50 is present on the detecting electrode 2012. The driving circuit may drive the previous detecting electrode to resume operation such that the droplet 50 may be able to continue to move in the microfluidic channel layer 40 along the first direction Y.

For example, in the course of a droplet 50 moving above a driving electrode 2011 under the control of a driving signal provided by the driving circuit, when the droplet 50 fails to reach the position of the detecting electrode 2012 due to unexpected reasons, the detecting electrode 2012 may send an abnormal signal to the detecting chip 60 to indicate that the droplet 50 does not reach the position of the detecting electrode 2012, and the detecting chip 60 may send an abnormal signal to the driving circuit to indicate that the droplet 50 does not reach the position of the detecting electrode 2012. The driving circuit may then drive the previous detecting electrode 2012 to resume operation such that the droplet 50 may be able to continue normal movement in the microfluidic channel layer 40 along the first direction Y.

It should be noted that, the previous detecting electrode 2012 may be, for example, a detecting electrode 2012 that is adjacent to the detected detecting electrode 2012 in a direction opposite to the moving direction of the droplet 50.

Figure 18:
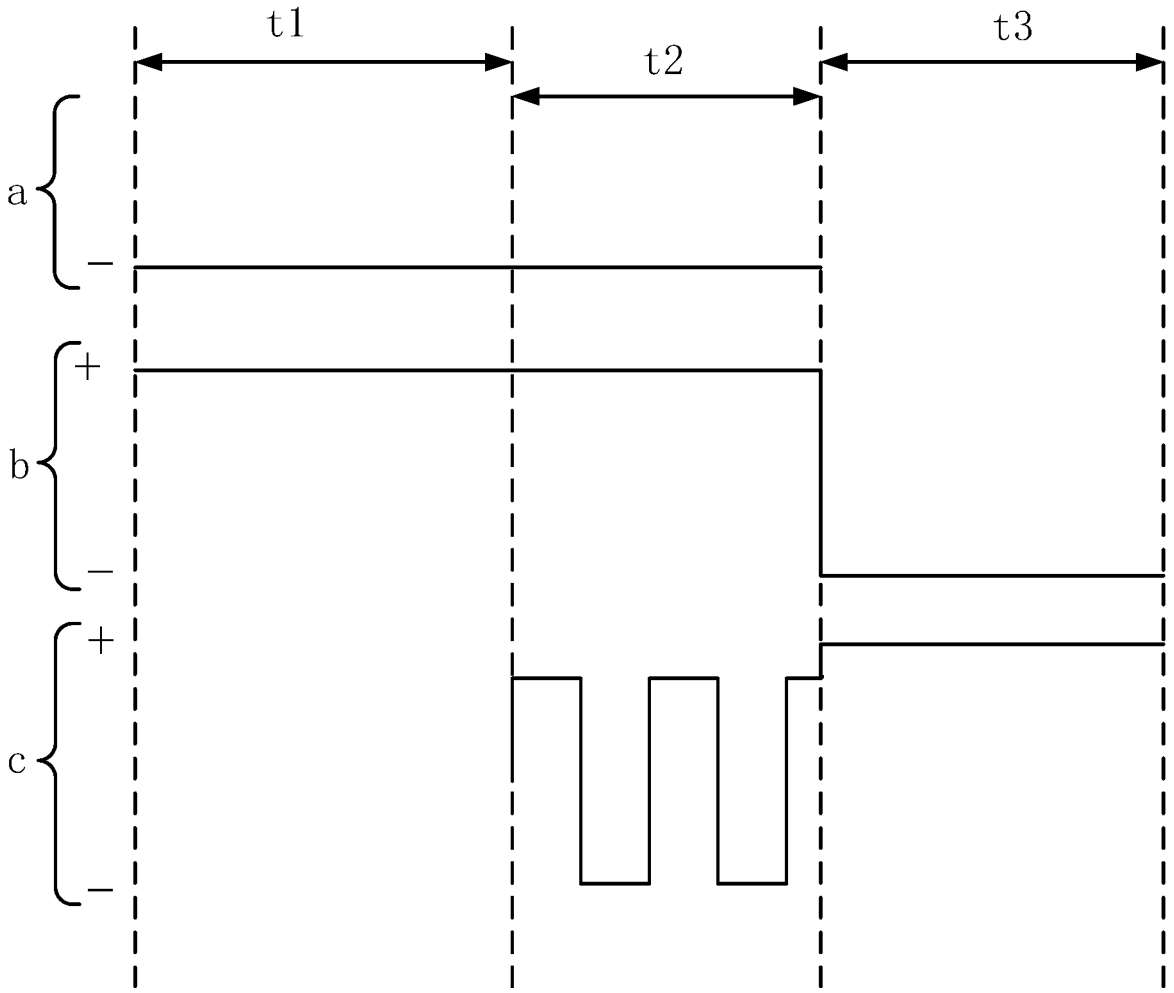
FIG. 18 illustrates a driving sequence diagram of a detecting electrode and two driving electrodes adjacent to the detecting electrode in a first direction according to various embodiments of the present disclosure.

FIG. 18 illustrates a driving sequence diagram of a detecting electrode and two driving electrodes adjacent to the detecting electrode in a first direction according to various embodiments of the present disclosure. For illustrative purposes, the droplet 50 is described to carry negative charges, and accordingly, the moving direction of the droplet 50 is in a direction opposite to the direction of the electrical field. Referring to FIG. 18, in one embodiment, the detecting electrode 2012 may serve as the output terminal of the detection signal, and the detecting chip 60 may receive the detection signal of the detecting electrode 2012.

During a first time period t1, the droplet 50 may have not reached the position of the detecting electrode 2012, and the capacitance detection may have not being started yet. The droplet 50 may move toward the detecting electrode 2012 from the previous driving electrode 2011. At this time, as shown in FIG. 18 (*a*), the driving circuit may provide a low-electric-potential signal to the driving electrode 2011; as shown in FIG. 18 (*b*), the driving circuit may provide a high-electric-potential signal to the detecting electrode 2012; and as shown in FIG. 18 (*c*), the driving circuit may not need to provide any signal to the next driving electrode 2011 that is adjacent to the detecting electrode 2012.

During a second time period t2, it may be expected that the droplet 50 just arrives at the position of the detecting electrode 2012, and as shown in FIG. 18 (*b*), the driving circuit may keep a high-electric-potential signal at the detecting electrode 2012 for a period of time. As shown in FIG. 18 (*c*), the detecting chip 60 may provide an AC signal to the next driving electrode 2011 (or the previous driving electrode 2011). It should be noted that in FIG. 18, an example in which the AC signal is sent to the next driving electrode 2011 adjacent to the detecting electrode 2012 is provided for illustration. Moreover, at this moment, the peak electric potential of the AC signal provided by the detecting chip 60 may be lower than the electric potential of the detecting electrode 2012. As shown in FIG. 18 (*a*), the driving circuit may provide a low-electric-potential signal to the previous driving electrode 2011 adjacent to the detecting electrode 2012. As such, the droplet 50 may be kept at the position of the detecting electrode 2012 for a certain period of time, and the capacitance detection may be performed to determine whether the droplet 50 reaches the position of the detecting electrode 2012.

During a third time period t3, the capacitance detection may be completed, and the result may indicate that the droplet 50 may have already moved normally to the position of the detecting electrode 2012. Accordingly, as shown in FIG. 18 (*b*), the electric-potential signal of the detecting electrode 2012 may be switched to a low-electric-potential signal through the driving circuit. In addition, as shown in FIG. 18 (*c*), the driving circuit may provide a high-electric-potential signal to the next driving electrode 2011 adjacent to the detecting electrode 2012. Further, as shown in FIG. 18 (*a*), the driving circuit may not need to provide any electric-potential signal to the previous driving electrode 2011 adjacent to the detecting electrode 2012, and the droplet 50 may continue to move.

Figure 19:
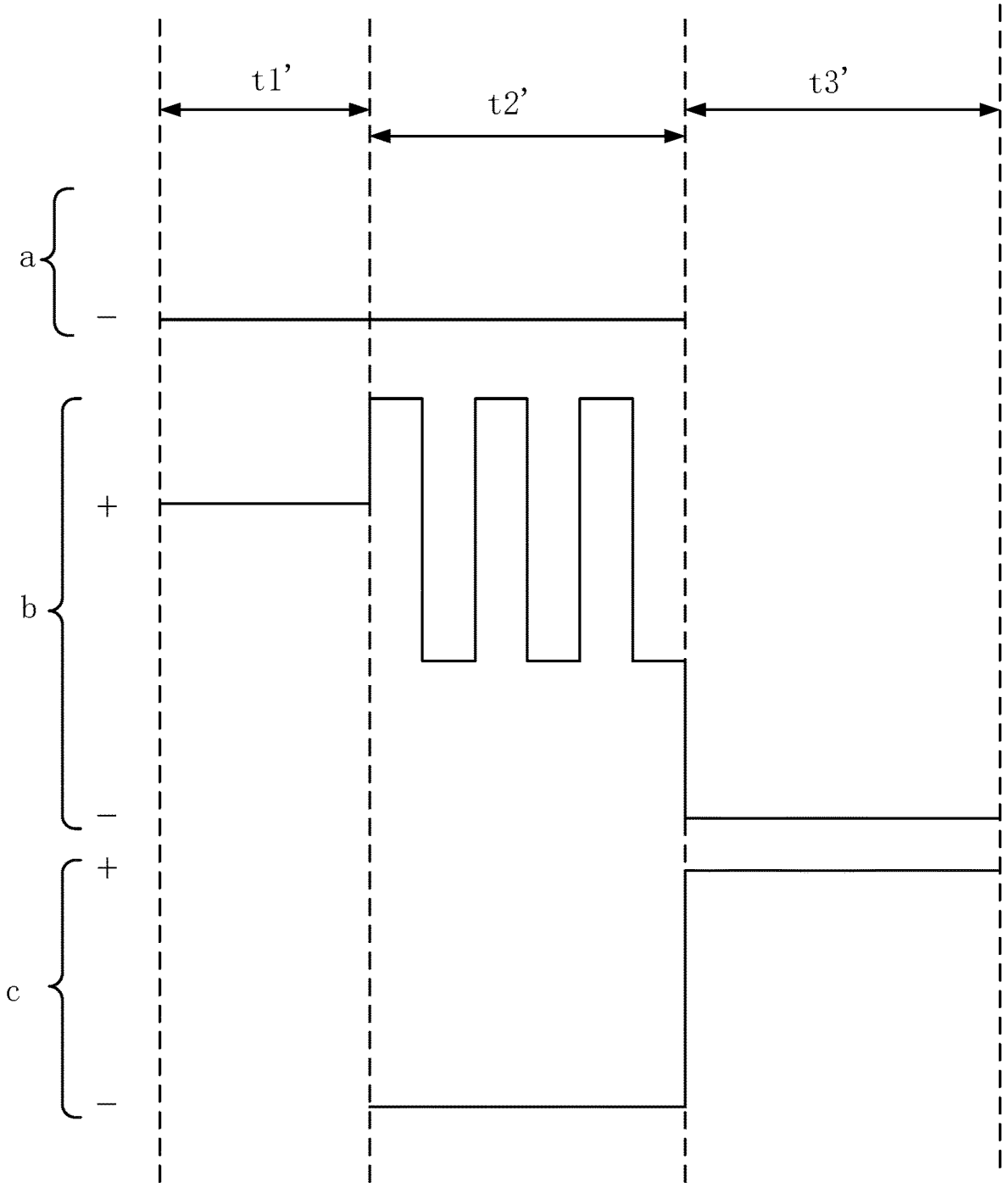
FIG. 19 illustrates another driving sequence diagram of a detecting electrode and two driving electrodes adjacent to the detecting electrode in a first direction according to various embodiments of the present disclosure.

FIG. 19 illustrates another driving sequence diagram of a detecting electrode and two driving electrodes adjacent to the detecting electrode in a first direction according to various embodiments of the present disclosure. For illustrative purposes, the droplet 50 is described to carry negative charges, and the moving direction of the droplet 50 is in a direction opposite to the direction of the electrical field. Referring to FIG. 19, in one embodiment, the detecting electrode 2012 may serve as the input terminal of the detection signal, and the detecting chip 60 may transmit an AC signal to the detecting electrode 2012.

During a first time period t1', the droplet 50 may have not reached the position of the detecting electrode 2012, and the capacitance detection may have not being started yet. The droplet 50 may move toward the detecting electrode 2012 from the previous driving electrode 2011. At this time, as shown in FIG. 19 (*a*), the driving circuit may provide a low-electric-potential signal to the driving electrode 2011; as shown in FIG. 19 (*b*), the driving circuit may provide a high-electric-potential signal to the detecting electrode 2012; and as shown in FIG. 19 (*c*), the driving circuit may not need to provide any signal to the next driving electrode 2011 that is adjacent to the detecting electrode 2012.

During a second time period t2', it may be expected that the droplet 50 just arrives at the position of the detecting electrode 2012, and as shown in FIGS. 19 (*a*) and (*c*), the driving circuit may keep a low-electric-potential signal at any one of the driving electrode 2011 adjacent to the detecting electrode 2012 for a period of time. As shown in FIG. 19 (*b*), the detecting chip 60 may provide an AC signal to the detecting electrode 2012. At this moment, the valley electric potential of the AC signal provided by the detecting chip 60 may be higher than the electric potential of any one of the driving electrodes 2011 adjacent to detecting electrode 2012. The capacitance detection may be performed to determine whether the droplet 50 reaches the position of the detecting electrode 2012.

During a third time period t3', the capacitance detection may be completed, and the result may indicate that the droplet 50 may have already moved normally to the position of the detecting electrode 2012. Accordingly, as shown in FIG. 19 (*b*), the electric-potential signal of the detecting electrode 2012 may be switched to a low-electric-potential signal through the driving circuit. In addition, as shown in FIG. 19 (*c*), the driving circuit may provide a high-electric-potential signal to the next driving electrode 2011 adjacent to the detecting electrode 2012. Further, as shown in FIG. 19 (*a*), the driving circuit may not need to provide any electric-potential signal to the previous driving electrode 2011 adjacent to the detecting electrode 2012, and the droplet 50 may continue to move.

Compared to existing electrowetting panels and operation methods, the disclosed electrowetting panel and operation method may be able to achieve at least the following beneficial effects.

According to the disclosed electrowetting panel and operation method, by applying an electrical voltage to each electrode through a driving circuit connected to the electrode, the electric potentials on adjacent electrodes are different such that an electric field is formed between adjacent electrodes. As such, a pressure difference and an asymmetric deformation can be generated inside a droplet, such that the droplet moves along a first direction in the microfluidic channel layer 40 above the insulating hydrophobic layer 30, and eventually reaches a desired position. The electrode array layer according to the disclosed electrowetting panel and operation method includes a plurality of electrodes arranged into an array. The plurality of electrodes includes a plurality of driving electrodes and a plurality of detecting electrodes, and along the first direction, the number of driving electrodes located between every two adjacent detecting electrodes is a non-negative integer N. A detecting chip is electrically connected to the plurality of detecting electrodes, and is used for transmitting electrical signals with the plurality of detecting electrodes. In the course of a droplet moving above a driving electrode under the control of a driving signal provided by the driving circuit, when the droplet fails to reach the position of the detecting electrode due to unexpected reasons, the detecting electrode sends an abnormal signal to the detecting chip to indicate that the droplet does not reach the position of the detecting electrode, and the detecting chip sends an abnormal signal to the driving circuit to indicate that the droplet is not present on the detecting electrode. The driving circuit then drives the previous detecting electrode to resume operation such that the droplet is able to continue normal movement in the microfluidic channel layer along the first direction.

The disclosed electrowetting panel and operation method are able to realize monitoring and feeding back whether a droplet reaches a designated position through the detecting electrode and the detecting chip. As such, abnormal function of the panel caused by abnormal movement of the droplet is prevented. In addition, based on the feedback information of the detecting chip, the driving circuit is able to re-provide a driving signal to the previous detecting electrode, such that the droplet may continue normal movement in the microfluidic channel layer, thereby improving the reliability of the panel operation.

The above detailed descriptions only illustrate certain exemplary embodiments of the present disclosure, and are not intended to limit the scope of the present disclosure. Those skilled in the art can understand the specification as whole and technical features in the various embodiments can be combined into other embodiments understandable to those persons of ordinary skill in the art. Any equivalent or modification thereof, without departing from the spirit and principle of the present disclosure, falls within the true scope of the present disclosure.

What is claimed is:

1. An electrowetting panel, comprising:

a base substrate; an electrode array layer; an insulating hydrophobic layer; and a microfluidic channel layer, wherein:

the electrode array layer is located on a side of the base substrate, wherein the electrode array layer includes a plurality of electrodes arranged into an array, each electrode of the plurality of electrodes is connected to a driving circuit, and the electrode array layer is configured to drive a droplet to move in the microfluidic channel layer along a first direction by applying an electric voltage on each electrode of the plurality of electrodes through the driving circuit corresponding to each electrode, the insulating hydrophobic layer is located on a side of the electrode array layer away from the base substrate, the microfluidic channel layer is located on a side of the insulating hydrophobic layer away from the electrode array layer, the plurality of electrodes includes a plurality of driving electrodes and a plurality of detecting electrodes, wherein along the first direction, a number N of the plurality of driving electrodes is located between every two adjacent detecting electrodes of the plurality of detecting electrodes, where N is a natural number, the electrowetting panel further including:

a detecting chip electrically connected to the plurality of detecting electrodes, the detecting chip is configured to receive a detection signal of a detecting electrode of the plurality of detecting electrodes, and the plurality of electrodes further includes a plurality of auxiliary electrodes, wherein:

along a second direction perpendicular to the first direction, the plurality of auxiliary electrodes is located on a side of the plurality of detecting electrodes; and each auxiliary electrode of the plurality of auxiliary electrodes is electrically connected to the detecting chip, and the detecting chip transmits a second electric-potential signal to the auxiliary electrode.

2. The electrowetting panel according to claim 1, wherein:

along the first direction, any driving electrode of the plurality of driving electrodes that is adjacent to the detecting electrode of the plurality of detecting electrodes is electrically connected to the detecting chip, wherein the detecting chip transmits a first electric-potential signal to the driving electrode of the plurality of driving electrodes that is adjacent to the detecting electrode of the plurality of detecting electrodes.

3. The electrowetting panel according to claim 2, wherein:

the first electric-potential signal is an alternating current (AC) signal; and when the detecting chip receives the detection signal of the detecting electrode, an electric potential of the detecting electrode is a first detecting electric-potential signal, and a peak electric potential of the first electric-potential signal is lower than an electric potential of the first detecting electric-potential signal.

4. The electrowetting panel according to claim 1, wherein:

the second electric-potential signal is an AC signal; and when the detecting chip receives the detection signal of the detecting electrode, an electric potential of the detecting electrode is a second detecting electric-potential signal, and a peak electric potential of the second electric-potential signal is lower than an electric potential of the second detecting electric-potential signal.

5. The electrowetting panel according to claim 1, wherein:

a length of the plurality of auxiliary electrodes in the first direction is smaller than or equal to a length of the plurality of detecting electrodes.

6. An electrowetting panel, comprising:

a base substrate; an electrode array layer; an insulating hydrophobic layer; and a microfluidic channel layer, wherein:

the electrode array layer is located on a side of the base substrate, wherein the electrode array layer includes a plurality of electrodes arranged into an array, each electrode of the plurality of electrodes is connected to a driving circuit, and the electrode array layer is configured to drive a droplet to move in the microfluidic channel layer along a first direction by applying an electric voltage on each electrode of the plurality of electrodes through the driving circuit corresponding to each electrode, the insulating hydrophobic layer is located on a side of the electrode array layer away from the base substrate, the microfluidic channel layer is located on a side of the insulating hydrophobic layer away from the electrode array layer, the plurality of electrodes includes a plurality of driving electrodes and a plurality of detecting electrodes, wherein along the first direction, a number N of the plurality of driving electrodes is located between every two adjacent detecting electrodes of the plurality of detecting electrodes, where N is a natural number, the electrowetting panel further including:

a detecting chip electrically connected to the plurality of detecting electrodes wherein:

the detecting chip is configured to transmit a third electric-potential signal to a detecting electrode of the plurality of detecting electrodes, wherein:

the third electric-potential signal is an AC signal, and a valley electric potential of the third electric-potential signal is higher than an electric potential of any electrode of the plurality of electrodes that is adjacent to the detecting electrode of the plurality of detecting electrodes.

7. The electrowetting panel according to claim 6, wherein:

the electrode array layer further includes a plurality of auxiliary electrode strips extending along the first direction, wherein:

each auxiliary electrode strip of the plurality of auxiliary electrode strips is electrically connected to the detecting chip, and the detecting chip is configured to receive a detection signal of the auxiliary electrode strip of the plurality of auxiliary electrode strips.

8. The electrowetting panel according to claim 6, wherein:

the electrode array layer includes a number M of electrodes of the plurality of electrodes in the first direction numbered from a first electrode to an $M^{th}$ electrode, where M is an integer larger than or equal to 3; and a length of the plurality of auxiliary electrode strips is equal to a distance from the first electrode to the $M^{th}$ electrode of the plurality of electrodes along the first direction.

9. The electrowetting panel according to claim 1, wherein:

edges of each electrode of the plurality of electrodes have zigzag structures.

10. The electrowetting panel according to claim 9, wherein:

edges of adjacent electrodes of the plurality of electrodes mutually, conformally fit with each other.

11. The electrowetting panel according to claim 6, wherein:

the detecting chip is configured to receive a detection signal of a detecting electrode of the plurality of detecting electrodes.

12. The electrowetting panel according to claim 11, wherein:

along the first direction, any driving electrode of the plurality of driving electrodes that is adjacent to the detecting electrode of the plurality of detecting electrodes is electrically connected to the detecting chip, wherein the detecting chip transmits a first electric-potential signal to the driving electrode of the plurality of driving electrodes that is adjacent to the detecting electrode of the plurality of detecting electrodes.

13. The electrowetting panel according to claim 12, wherein:

the first electric-potential signal is an alternating current (AC) signal; and when the detecting chip receives the detection signal of the detecting electrode, an electric potential of the detecting electrode is a first detecting electric-potential signal, and a peak electric potential of the first electric-potential signal is lower than an electric potential of the first detecting electric-potential signal.

14. The electrowetting panel according to claim 11, wherein:

the plurality of electrodes further includes a plurality of auxiliary electrodes, wherein:

along a second direction perpendicular to the first direction, the plurality of auxiliary electrodes is located on a side of the plurality of detecting electrodes; and each auxiliary electrode of the plurality of auxiliary electrodes is electrically connected to the detecting chip, and the detecting chip transmits a second electric-potential signal to the auxiliary electrode.

15. The electrowetting panel according to claim 14, wherein:

the second electric-potential signal is an AC signal; and when the detecting chip receives the detection signal of the detecting electrode, an electric potential of the detecting electrode is a second detecting electric-potential signal, and a peak electric potential of the second electric-potential signal is lower than an electric potential of the second detecting electric-potential signal.

16. The electrowetting panel according to claim 14, wherein:

a length of the plurality of auxiliary electrodes in the first direction is smaller than or equal to a length of the plurality of detecting electrodes.

17. An operation method of an electrowetting panel, comprising:

providing the electrowetting panel, including a base substrate; an electrode array layer; an insulating hydrophobic layer; and a microfluidic channel layer, wherein:

the electrode array layer is located on a side of the base substrate, wherein the electrode array layer includes a plurality of electrodes arranged into an array, each electrode of the plurality of electrodes is connected to a driving circuit, and the electrode array layer is configured to drive a droplet to move in the microfluidic channel layer along a first direction by applying an electric voltage on each electrode of the plurality of electrodes through the driving circuit corresponding to each electrode, the insulating hydrophobic layer is located on a side of the electrode array layer away from the base substrate, the microfluidic channel layer is located on a side of the insulating hydrophobic layer away from the electrode array layer, the plurality of electrodes includes a plurality of driving electrodes and a plurality of detecting electrodes, wherein along the first direction, a number N of the plurality of driving electrodes is located between every two adjacent detecting electrodes of the plurality of detecting electrodes, where N is a natural number, and the electrowetting panel further includes a detecting chip electrically connected to the plurality of detecting electrodes;

in a first stage, using a detecting electrode and a driving electrode as transmission electrodes; and providing signals, by the driving circuit, with different electric potentials to the plurality of electrodes to generate an electric field between adjacent electrodes in the first direction to drive the droplet to move along the first direction in the microfluidic channel layer, and in a second stage, using the detecting electrode as an electrode for detecting the droplet; providing an electric potential of the detecting electrode higher than electric potentials of other electrodes adjacent to the detecting electrode by transmitting an electric-potential signal through the detecting chip; and determining whether the droplet is present on the detecting electrode according to a difference in a detection signal received by the detecting chip.

18. The operation method according to claim 17, wherein determining whether the droplet is present on the detecting electrode according to the difference in the detection signal received by the detecting chip includes:

determining whether the droplet is currently present on the detecting electrode according to the difference in the detection signal received by the detecting chip wherein:

when the droplet is present on the detecting electrode, a first capacitor is formed between the detecting electrode and other electrodes adjacent to the detecting electrode; and when the droplet is not present on the detecting electrode, a second capacitor is formed between the detecting electrode and the other electrodes adjacent to the detecting electrode, wherein:

a capacitance value of the first capacitor is different from a capacitance value of the second capacitor, and detection signals received by the detecting chip and corresponding to the capacitance value of the first capacitor and the capacitance value of the second capacitor, respectively are different.

19. The operation method according to claim 17, wherein:

when the droplet is present on the detecting electrode, the driving circuit continues to operate, and the droplet continues to move in the microfluidic channel layer along the first direction; and when the droplet is not present on the detecting electrode, the detecting chip sends an abnormal signal to the driving circuit to indicate that the droplet is not present on the detecting electrode, and the driving circuit drives a previous detecting electrode to resume operation such that the droplet continues to move normally in the microfluidic channel layer along the first direction.

20. The operation method according to claim 19, wherein:

the previous detecting electrode is a detecting electrode that is adjacent to the electrode for detecting the droplet in a direction opposite to a moving direction of the droplet.

* * * * *